US007726804B2

(12) United States Patent
Takeuchi et al.

(10) Patent No.: US 7,726,804 B2
(45) Date of Patent: Jun. 1, 2010

(54) MEDIUM SUPPLYING APPARATUS, METHOD FOR DRIVING MEDIUM SUPPLYING APPARATUS, COMPUTER READABLE MEDIUM INCLUDING DRIVE-CONTROL PROGRAM AND RECORDING DEVICE

(75) Inventors: Atsuhiko Takeuchi, Nagano (JP); Satoshi Negishi, Nagano (JP); Naoki Horie, Nagano (JP); Katsumi Okuhara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 858 days.

(21) Appl. No.: 11/254,755

(22) Filed: Oct. 21, 2005

(65) Prior Publication Data

US 2006/0098072 A1 May 11, 2006

(30) Foreign Application Priority Data

Oct. 21, 2004 (JP) ..... P2004-307498

(51) Int. Cl.
*B41J 2/01* (2006.01)
*B41J 29/38* (2006.01)

(52) U.S. Cl. ..... 347/104; 347/16

(58) Field of Classification Search ..... 347/104, 347/16, 101, 5

See application file for complete search history.

(56) References Cited

U.S. PATENT DOCUMENTS 5,201,508 A * 4/1993 Kuo ..... 271/10.03
5,219,154 A * 6/1993 Fukube et al. ..... 271/18.2
5,228,673 A * 7/1993 Osonoe ..... 271/10.01
5,322,269 A * 6/1994 Fukube et al. ..... 271/18.1
5,882,004 A 3/1999 Padget
5,897,259 A * 4/1999 Ahn ..... 400/629
6,082,729 A 7/2000 Padget
6,135,444 A 10/2000 Padget
6,169,561 B1 * 1/2001 Fisher, Sr. ..... 347/218
6,338,480 B1 1/2002 Endo
6,382,618 B1 * 5/2002 Takada ..... 271/10.01
6,648,322 B2 * 11/2003 Park ..... 271/117
6,793,425 B2 * 9/2004 Yoshikawa et al. ..... 400/624
6,900,611 B2 * 5/2005 Yoshino et al. ..... 318/696

(Continued)

FOREIGN PATENT DOCUMENTS

EP 0398301 A2 11/1990

(Continued)

OTHER PUBLICATIONS

Partial European Search Report dated May 28, 2008.

(Continued)

*Primary Examiner*—Stephen D Meier
*Assistant Examiner*—Leonard S Liang
(74) *Attorney, Agent, or Firm*—Sughrue Mion, PLLC

(57) ABSTRACT

A method for driving a medium supplying apparatus which supplies medium by a pick-up roller, wherein an operation of stopping rotation of the pick-up roller is inserted at least one of before an operation of supplying medium to a separating position where, when a plurality of sheets of medium are fed together by the pick-up roller displaced to the supplying position, an uppermost sheet of the plurality of sheets of medium is separated from a lower sheet or sheets, and before an operation of returning the separated lower sheet or sheets after separating the uppermost sheet from the lower sheet or sheets.

9 Claims, 18 Drawing Sheets

U.S. PATENT DOCUMENTS

| | | | | |
|---|---|---|---|---|
| 7,007,950 | B2 * | 3/2006 | Im | 271/258.01 |
| 7,156,389 | B2 * | 1/2007 | Kadowaki et al. | 271/118 |
| 2001/0019192 | A1 * | 9/2001 | Yen et al. | 271/117 |
| 2001/0052921 | A1 * | 12/2001 | Kabamoto | 347/104 |
| 2005/0023745 | A1 * | 2/2005 | Morimoto et al. | 271/117 |

FOREIGN PATENT DOCUMENTS

| | | | | |
|---|---|---|---|---|
| EP | 1132215 | A2 | | 9/2001 |
| EP | 1186430 | A2 | | 3/2002 |
| EP | 1256534 | A2 | | 11/2002 |
| JP | 2-144335 | A | | 6/1990 |
| JP | 3-172238 | A | | 7/1991 |
| JP | 05178487 | A | * | 7/1993 |
| JP | 06092510 | A | * | 4/1994 |
| JP | 7144781 | A | | 6/1995 |
| JP | 9-183529 | A | | 7/1997 |
| JP | 10-35911 | A | | 2/1998 |
| JP | 10-087093 | A | | 4/1998 |
| JP | 10-167495 | A | | 6/1998 |
| JP | 2002-068503 | A | | 3/2002 |
| JP | 2002-145469 | A | | 5/2002 |
| JP | 2003-201035 | A | | 7/2003 |
| JP | 2003-276890 | A | | 10/2003 |
| WO | 0015527 | A1 | | 3/2000 |

OTHER PUBLICATIONS

Extended European Search Report dated Nov. 7, 2008.

* cited by examiner

MEDIUM SUPPLYING APPARATUS, METHOD FOR DRIVING MEDIUM SUPPLYING APPARATUS, COMPUTER READABLE MEDIUM INCLUDING DRIVE-CONTROL PROGRAM AND RECORDING DEVICE

BACKGROUND OF THE INVENTION

1. Technical Field of the Invention

The invention relates to a driving supplying apparatus, a driving method for supplying a medium and a computer readable medium including drive-control program for a medium supplying apparatus, and a recording device and a liquid jetting device each provided with the medium supplying apparatus.

2. Description of the Related Art

An ink jet printer which is one of recording devices includes a type in which paper is supplied from a rear side and ejected to a front side, and another type in which paper is supplied/ejected on the front side. The type of the printer in which paper is supplied/ejected on the front side is provided with a paper supply tray arranged on the lower stage of the front of the apparatus and a paper eject stacker arranged on the upper stage thereof. When sheets of paper housed in the paper supply tray are pile-fed by a pick-up roller, only an uppermost sheet is separated and the remaining lower sheet(s) is returned to the paper supply tray. And the uppermost sheet is inverted by an inverting roller, transported by a paper feeding roller, and subjected to recording. The paper is eventually ejected onto the ejecting stacker by an ejecting roller (see, for example JP-A-2003-276890).

In the related art ink jet printer as described above, owing to the paper supplying speed based on a paper type and recording mode, number of set sheets of paper and changes in a paper setting manner, if the tips of sheets of paper are uneven, deterioration in the feeding performance such as paper tip buckling by a paper return lever, non-feeding and poor paper tip positioning occurs.

SUMMARY OF THE INVENTION

This invention has been accomplished in view of the above various problems and an object of the invention is to provide a medium supplying apparatus which can keep preferred medium supplying, a driving method and a computer readable medium including drive-control program for a medium supplying apparatus, and a recording device and a liquid jetting device each provided with the medium supplying apparatus. The present invention is as follows:

(1). A method for driving a medium supplying apparatus which supplies medium by a pick-up roller, wherein an operation of stopping rotation of the pick-up roller is inserted at least one of before an operation of supplying medium to a separating position where, when a plurality of sheets of medium are fed together by the pick-up roller displaced to the supplying position, an uppermost sheet of the plurality of sheets of medium is separated from a lower sheet or sheets, and before an operation of returning the separated lower sheet or sheets after separating the uppermost sheet from the lower sheet or sheets.

(2). The method according to item (1), wherein the pick-up roller is displaceable between a supplying position and a retracting position and wherein the operation of stopping the rotation is changed according to the supplying position and retracting position of the pick-up roller.

(3). The method according to item (1), wherein the operation of stopping the rotation is changed according to types of medium.

(4). A computer readable medium including a set of instructions for a medium supplying apparatus which supplies medium by a pick-up roller, the set of instructions comprising:

an operation of stopping rotation of the pick-up roller is inserted at least one of before an operation of supplying medium to a separating position where, when a plurality of sheets of medium are fed together by the pick-up roller displaced to the supplying position, an uppermost sheet of the plurality of sheets of medium is separated from a lower sheet or sheets, and before an operation of returning the separated lower sheet or sheets after separating the uppermost sheet from the lower sheet or sheets.

(5). A medium supplying apparatus for supplying a medium, wherein the driving method according to item (1) can be adopted.

(6). A recording device for making a record on a medium, comprising the medium supplying apparatus according to item (5).

(7). A method for driving the medium supplying apparatus according to item (6), wherein the operation of stopping the rotation is changed according to a recording condition.

(8). A liquid jetting device for jetting liquid onto a medium, comprising the medium supplying apparatus according to item (5).

(9). A method of controlling a medium supplying device (144) having a pick-up roller (41) driven by a motor, an intermediate roller (45) disposed downstream of the pick-up roller (41) along a medium path, a retard roller (61) facing the intermediate roller (45), and a paper return (71) movable to enter the medium path, the method comprising the steps of:

(a) contacting the pick-up roller (41) with a sheet of medium;

(b) rotating the motor, while keeping the pick-up roller (41) in contact with the sheet of medium, so that the pick-up roller (41) picks up and supplies the sheet of medium along the medium path to a first position of the medium path where the retard roller (61) faces the intermediate roller (45) and to a second position of the medium path where the paper return (71) enters the medium path; and (c) inserting stoppage of the motor for a predetermined time period into a duration lasting from a time point at which the rotation of the motor in the step (b) is started and to a time point at which the sheet of medium reaches the first or second position.

(10). The method according to item (9), wherein the inserting stoppage of the motor (c) is changed according to a position of the pick-up roller (41).

(11). The method according to item (9), wherein the inserting stoppage of the motor (c) is changed according to types of medium.

(12). A method of controlling a medium supplying device (134) having a paper supplying roller (32) driven by a motor, a retard roller (33) facing the paper supplying roller (32), and a paper return (34) movable to enter a medium path, the method comprising the steps of:

(a) contacting the paper supplying roller (32) with a sheet of medium;

(b) rotating the motor, while keeping the paper supplying roller (32) in contact with the sheet of medium, so that the paper supplying roller (32) picks up and supplies the sheet of medium along the medium path to a first position of the medium path where the retard roller (33) faces the paper supplying roller (32) and to a second position of the medium path where the paper return (34) enters the medium path; and (c) inserting stoppage of the motor for a predetermined time period into a duration lasting from a time point at which the rotation of the motor in the step (b) is started and to a time point at which the sheet of medium reaches the first or second position.

(13). A method of controlling a medium supplying device (144) having a pick-up roller (41) driven by a motor and displaceable between a supplying position and a retracting position, the method comprising the steps of:

(a) judging whether the pick-up roller (41) is disposed at the supplying position or the retracting position;

(b) displacing the pick-up roller to dispose the pick-up roller (41) at the supplying position, and rotating the motor for a first predetermined time period if it is judged, in the step (a), that the pick-up roller (41) is disposed at the retracting position;

(c) rotating the motor for a second predetermined time period if it is judged, in the step (a), that the pick-up roller is disposed at the supplying position, wherein the first predetermined time period is longer than the second predetermined time period.

DETAILED DESCRIPTION OF THE INVENTION

Figure 1:
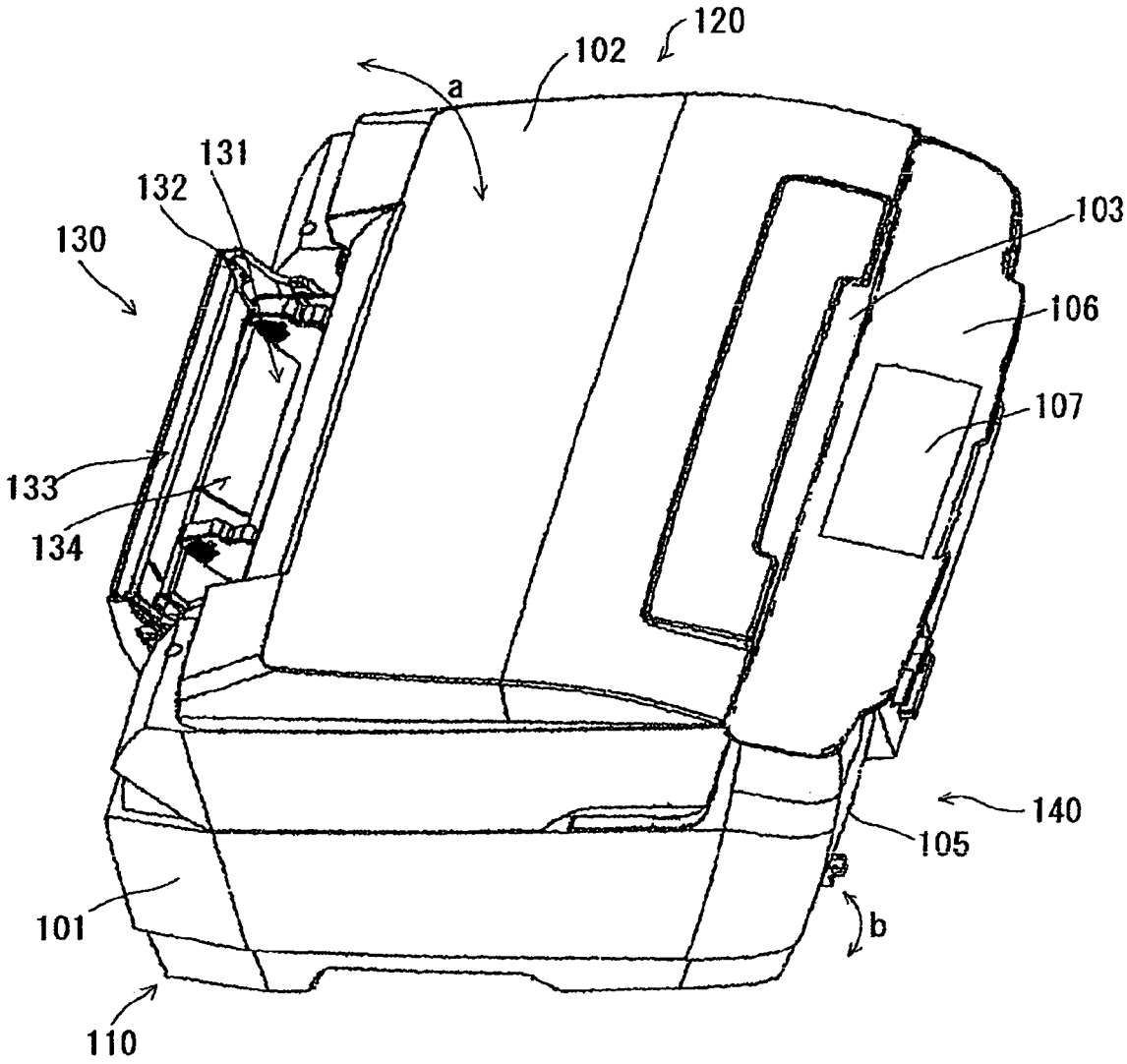
FIG. 1 is a perspective view showing the entire appearance of an ink jet composite machine which is one of recording devices according to an embodiment of this invention.
Figure 2:
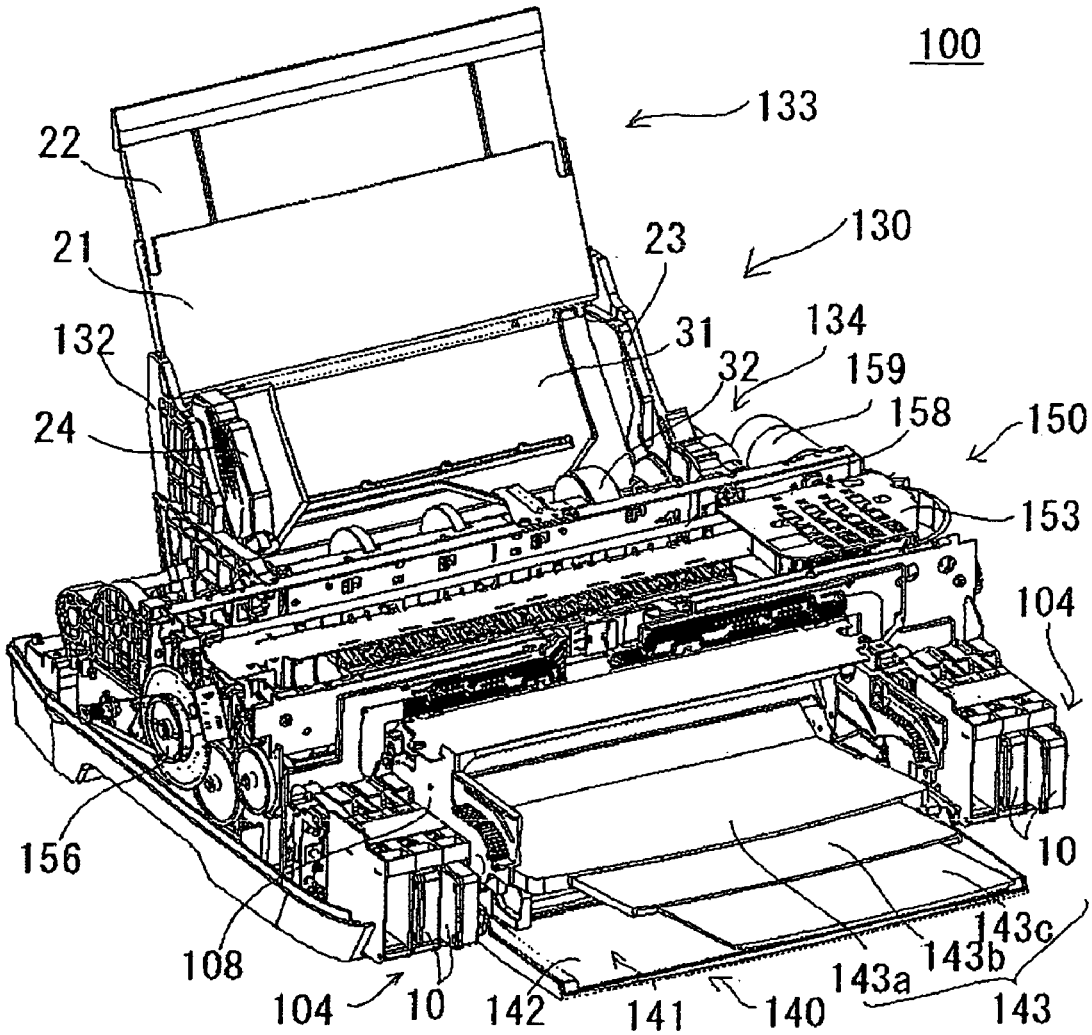
FIG. 2 is a perspective view of the internal structure of the composite machine shown in FIG. 1.
Figure 3:
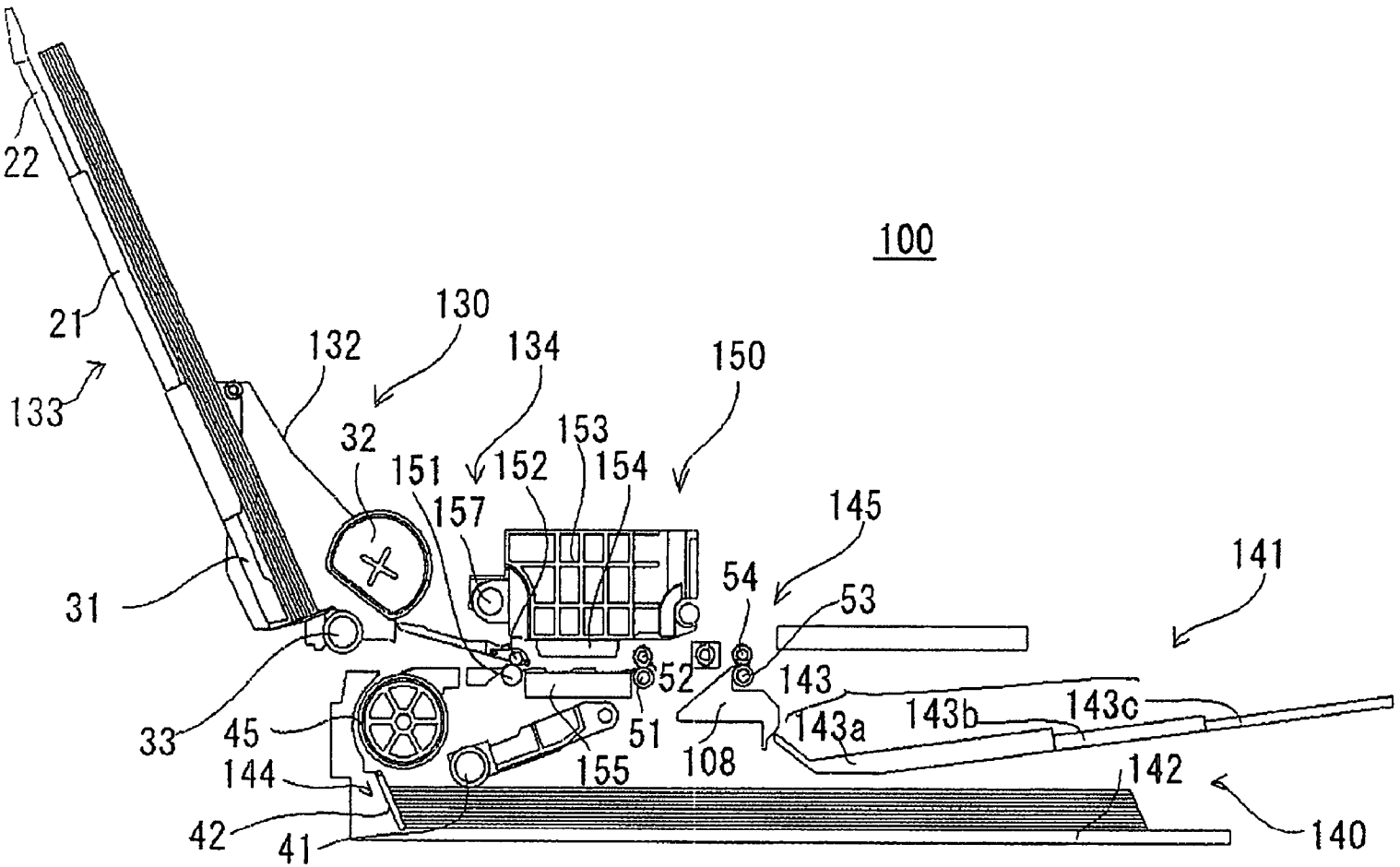
FIG. 3 is a schematic side view of the composite machine shown in FIG. 2.

FIG. 1 is a perspective view showing the entire appearance of an ink jet composite machine which is one of recording devices according to an embodiment of this invention. FIG. 2 is a perspective view of its internal structure. FIG. 3 is a schematic side view thereof. An ink jet composite machine 100 has a printer function permitting recoding on e.g. a cut sheet from L-size or A6 size to A4 size in the JIS standard or a post card, a scanner function permitting reading a document to the A4 size in the JIS standard and the document to a letter size in the US standard, and a copying function permitting copying on a sheet of L-size, 2L-size, B5-size, A4-size and "six-cut" size (8"×10"), post card size.

The ink jet composite machine 100, as seen from FIG. 1, is covered with a housing 101 having a entire shape of nearly rectangular parallelepiped and has a structure in which a printer 110 is arranged on the lower stage and a scanner 120 is arranged on the upper stage. On the rear side, a paper supply portion 130 including a feature of this invention is arranged and on the front side, a paper supply/eject portion 140 including a feature of this invention is arranged. A user can select one or both of the paper supply portion 130 and paper supply/eject portion 140 on the front side as a paper setting direction before recording. For this reason, the flexibility of the setting position of the ink jet composite machine 100 can be enhanced. In addition, the paper after recorded is always ejected from the supply/eject portion 140 on the front side so that the user can easily take out the paper.

On the upper face of the housing 101, a scanner cover 102 having a square flat plate shape is arranged. The scanner cover has a handle 103 on the front side and is attached to be rotatable in a direction of indicated arrow a around a rotary shaft on the rear side. The user, when using the scanner 120, can open/close the scanner cover 103 by inserting his finger in the handle 103 and so easily load/unload a document.

On both sides of the front of the housing 101, cartridge housing portions 104 in/from which a plurality of ink cartridges 104 as shown in FIG. 2 are inserted/extracted are formed. Each ink cartridge 10 collects ink of each color for recording. Each cartridge housing portion 104 is covered with a transparent or semitransparent cartridge cover 105. The cartridge cover 105 is attached to be rotatable in an indicated arrow b around the rotary shaft on the lower side. The user can carry out an operation of replacing the ink cartridge 10 by only softly pushing the cartridge cover 105 to remove a securing portion and opening the cartridge housing portion 104, without lifting the entire scanner 120 which is heavy to open the inside of the printer as before, thereby improving the operation efficiency.

On this side of the scanner cover 102 on the upper surface of the housing 101, as seen from FIG. 1, an operation portion 106 for designating each operation of the printer 110, scanner 120 and copying is arranged. The operation portion 106 is provided with buttons not shown for a power system for power on/off, an operation system for paper tip positioning or ink flashing, processing system for e.g. image processing, and a liquid crystal panel 107 indicating the status, and others.

Thus, the user can operate the buttons and others while seeing the liquid crystal panel 107 for confirmation.

Within the housing 101, as seen from FIGS. 2 and 3, arranged are the supply/eject portion 140, paper supply portion 130, recording portion 150, etc. The paper supply portion 130 has a rear paper supply mouth 131 opened upward in a square and a frame 132 formed along both end edges and rear edge thereof. The frame 132, as seen from FIGS. 1 to 3, is provided with a paper support 133 for supporting one or plural sheets of paper to be supplied, a rear auto sheet feeder 134 (hereinafter referred to as rear ASF), which is one feature of this invention, for automatically one-by-one supplying sheets of paper supported by the paper support 133, etc.

Figure 4:
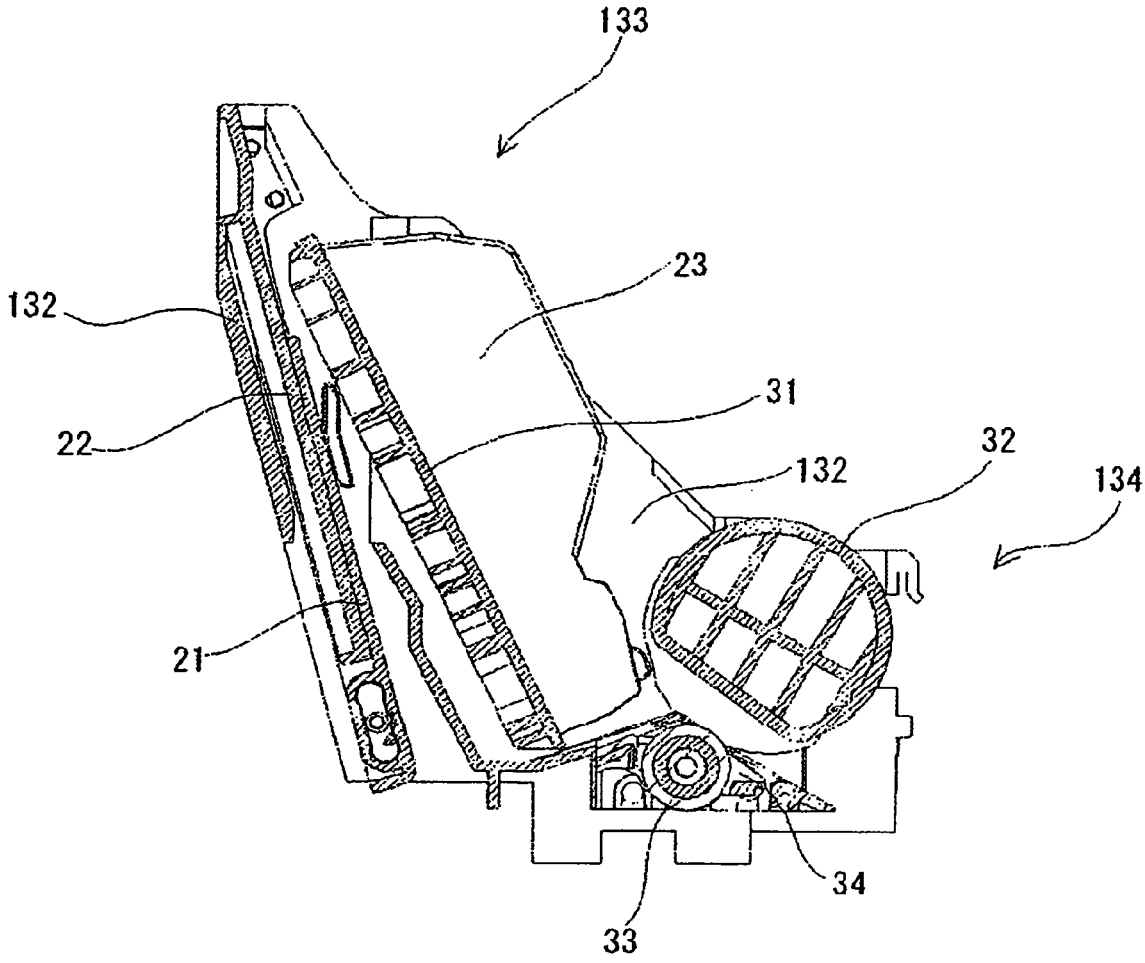
FIG. 4 is a side view of the details of a paper support and a rear ASF (Auto sheet Feeder) in the composite machine shown in FIG. 1.

FIG. 4 is a side view of the details of the paper support 133 and rear ASF 134. Now referring to FIGS. 1 to 4, the paper support 133 includes a first support 21 and a second support 22 for supporting the rear side of the paper and a fixed guide 23 and a movable guide 24 for guiding both side edges of the paper. The rear ASF 134 includes a hopper 31 for lifting the paper supported by the paper support 133 for its feeding, a feeding roller 32 for taking out the paper lifted by the hopper 31, a retard roller 33 for separating only one sheet from the sheets of paper pile-fed by the feeding roller 32, and a rear paper returning unit 34 for returning the sheet(s) left by the retard roller 33 to the hopper 31.

The first support 21 is formed in a flat-plate shape and arranged so that it can be freely housed in and pulled out from the inside of the rear wall of the frame 132. The second support 22 is formed in a flat-plate shape and arranged so that it can be freely housed in and pulled out from the first support 21. The first support 21 and the second support 22 are formed so as to be expandable in a paper supplying direction so that they can be housed compactly during their non-use. They can surely support the paper with various sizes during their use.

The fixed edge guide 23 is formed integrally to the hopper 31 in a shape along the right side wall of the frame 132 when viewed from the front side of the apparatus. The movable edge guide 24 is formed in a shape along the left side wall of the frame 132 when viewed from the front side of the apparatus. The hopper 31 is attached so that it can move in nearly parallel to the rear wall of the frame 132 between the left side wall and right side wall of the frame 132. The fixed edge guide 23 and movable edge guide 24 can surely guide both side edges of the paper with different sizes so that paper supplying can be carried out with high accuracy.

The hopper 31 is formed in a flat-plate shape on which paper can be placed and arranged in nearly parallel to the rear wall of the frame 132. The lower end of the hopper 31 is located in the vicinity of the paper supplying roller 32 whereas the upper end thereof is located in the proximity of the top of the rear wall of the frame 132. The other end of a compression spring (not shown) whose one end is attached to the rear wall of the frame 132 is attached to the rear face of the hopper 31 on the lower end side. The lower end side of the hopper 31 is turned around the upper end side by expansion/contraction of the compression spring.

The paper supplying roller 32 is formed in D-shape with its section partially recessed and arranged in the vicinity of the lower end of the hopper 31. The paper supplying roller 32 rotates intermittently to friction-feed the paper lifted by the hopper 31. The retard roller 33 is arranged to be contactable with the paper supplying roller 32, and friction-separates the only the uppermost sheet from the lower sheet(s) when the sheets of paper are pile-fed by the paper feeding roller 32. The rear paper returning unit 34 is formed in a lug shape and arranged in the vicinity of the paper supplying roller 32. The rear paper returning unit 34 returns the lower sheet(s) separated by the retard roller 33 to the hopper 31 by catching the sheet(s) with the lug.

The paper supply/eject portion 140, as seen from FIGS. 2 and 3, has a front paper supply/eject mouth 141 opened forward in a square shape. On the lower side of the front paper supply/eject mouth 141, a paper supply tray 142 is arranged. On the upper side of the paper supply tray 142, a paper eject tray 143 is arranged. Behind the front paper supply/eject mouth 141, as seen from FIG. 3, arranged are a front auto sheet feeder 144 (hereinafter referred to as front ASF), which is another feature of this invention, for automatically one-by-one supplying sheets of paper housed in the paper supply tray 142 and a front paper ejecting mechanism 145 (hereinafter referred to as front EJ) for automatically eject-feeding the paper toward a paper eject tray 143.

The paper supply tray 142, as seen from FIGS. 2 and 3, is formed in a flat-plate shape, and on the upper surface thereof a pile of non-recorded sheets of paper to be supplied are housed. The paper eject tray 143, as seen from FIGS. 2 and 3, includes a first tray 143*a*, a second tray 143*b* and a third tray 143*c*. The first tray 143*a* is formed in a flat-plate shape and its rear side is rotatably attached to a body frame 108 behind the paper supply/eject portion 140. The second tray 143*b* is formed in a flat-plate shape and arranged so that it can be freely housed in or pulled out from the first tray 143*a*. The third tray 143*c* is formed in a flat-plate shape and arranged so that it can be housed in or pulled out from the second tray 143*b*.

The paper eject tray 143 is adapted so that a pile of recorded sheets of paper is placed on the upper surface thereof in a state where the second tray 143*b* and the third tray 143*c* have been pulled out. The second tray 143*b* and third tray 143*c* are formed so as to be expandable in a paper ejecting direction so that they can be housed compactly during their non-use. They can surely place a pile of sheets of paper with various sizes to be ejected during their use. Incidentally, the paper supply/eject portion 140 is formed so that the tray in which thick paper or an optical disk incapable of being bent during the paper supply/eject can be supplied manually.

Figure 5:
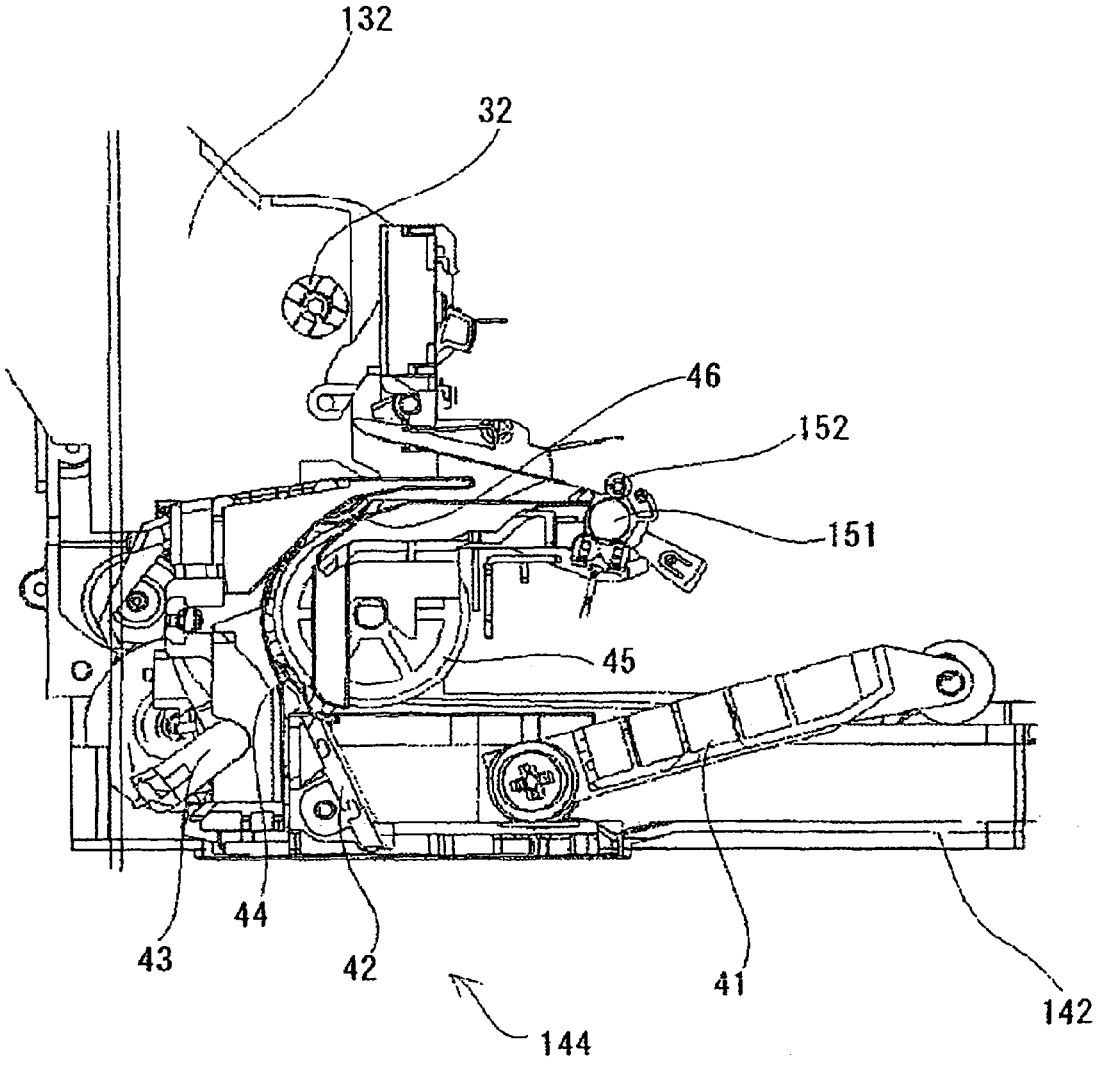
FIG. 5 is a side view of the details of the front ASF of the composite machine shown in FIG. 1.

FIG. 5 is a side view of the details of the front ASF 144. Now referring to FIGS. 3 and 5, the front ASF will be explained. The front ASF 144 includes a pick-up roller unit 41 for taking out the sheets of paper housed in the paper supply tray 142 and a bank 42 for changing the direction of the sheets of paper taken out by the pick-up roller unit 41. The front ASF 144 further includes a retard roller unit 43 for separating the sheets of paper pile-fed by the pick-up roller unit 41 into a single sheet, a front paper returning unit 44 for returning the remaining sheet(s) separated by the retard roller unit 43 to the paper supply tray 142, an intermediate roller 45 and an assist roller 46 for inverting the paper supply-fed like a U-shape, etc.

The pick-up roller 41 is arranged above the rear side of the paper supply tray 142 and turnable up and down for the paper supply tray 142. The pick-up roller 41 serves to descend to friction supplies the paper housed in the paper supply tray 142. The bank 42 is arranged to incline rearward on the rear side of the paper supply tray 142, and serves to upward change the direction of the tip of the paper supply-fed by the pick-up roller unit 41.

The retard roller unit 43 is arranged to be contactable with the intermediate roller 45 and serves to friction-separate only the uppermost sheet from the lower sheet(s) when the sheets of paper are pile-fed by the pick-up roller unit 41. The front paper returning unit 44 is formed in a lug shape and arranged in the vicinity of the retard roller unit 43. The front paper returning unit 44 returns the lower sheet(s) separated by the retard roller unit 43 to the paper supply tray 142 by catching the sheet with the lug. The assist roller 46 is arranged to be always in contact with the intermediate roller 45 so that it inverts like the U-shape, the uppermost sheet separated by the retard roller unit 43 by sandwiching it together with the intermediate roller 45 and supplies it to a platen 155.

The front FJ 145, as seen from FIG. 3, includes a first paper eject roller 51 and first notched roller 52, and a second paper eject roller 53 and a second notched roller 53. The first paper eject roller 51 is arranged on the transporting downstream side of the platen 155 and eject-feeds the paper passed the platen 155 by sandwiching it together with the first notched roller 52. The second paper roller 53 is arranged on the transporting downstream side of the first paper eject roller 51 and eject-feeds the paper onto the paper eject tray 143 by sandwiching it together with the second notched roller 54.

In a recording portion 150, as seen from FIG. 3, arranged are a paper feed roller 151 for feeding the paper in a sub-scanning direction synchronously with a recording operation, its following roller 152, a carriage 153 for feeding the paper in a main-scanning direction synchronously with the recording operation, a recording head 154 for jetting out ink synchronously with the recording operation, platen 155 for keeping flat the paper during the recording operation, etc.

The paper feed roller 151, as seen from FIG. 3, is arranged on the transporting upstream side of the platen 155, and serves to feed out the paper supply-fed by the paper supply roller 32 or inverted and supply-fed by the intermediate roller 45 toward the platen 155 by sandwiching it together with the following roller 152 through the paper feeding mechanism 156 as shown in FIG. 2. The carriage 153 is penetration-attached to a carriage guide shaft 157 as shown in FIG. 3 above the platen 155 and coupled with a carriage belt 158 as shown in FIG. 2. When the carriage belt 158 is operated by a carriage motor 159 as shown in FIG. 2, the carriage 153 accompanies the movement of the carriage belt 158 so that it is guided by the carriage guide shaft 157 to make a reciprocating motion.

A recording head 154, as seen from FIG. 3, is loaded on the carriage 153 so as to be apart from the platen 155 by a predetermined interval. The recording head 154 includes a black ink recoding head for jetting out e.g. a black ink and a plurality of color ink recording heads for jetting out five colors of yellow, cyan, right-cyan, magenta, right-magenta, respectively. The recording head 154 is provided with a pressure generating chamber and a nozzle opening coupled therewith, and serves to jet out ink drops with a controlled size toward the paper from the nozzle opening by pressurizing the ink collected within the pressure generating chamber at a predetermined pressure. Next, further referring to the drawings, an explanation will be given of the front ASF 144 which is the feature of this invention.

Figure 6A:
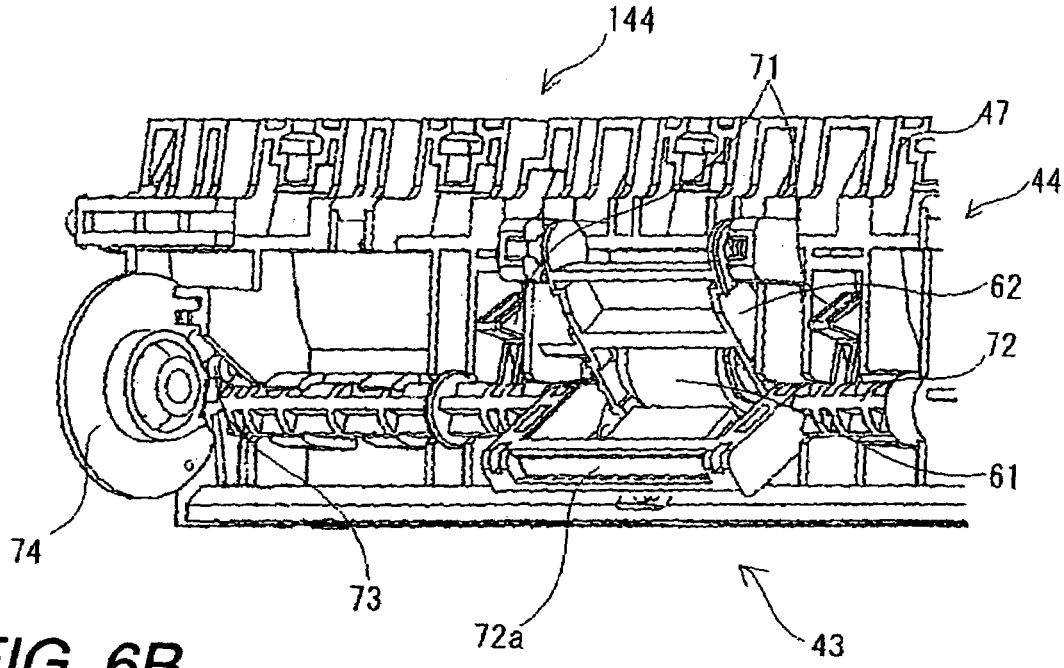
FIG. 6A is a perspective view of the details of the main part of FIG. 5 when viewed from the rear side and FIG. 6B is an enlarged view of FIG. 6A.
Figure 6B:
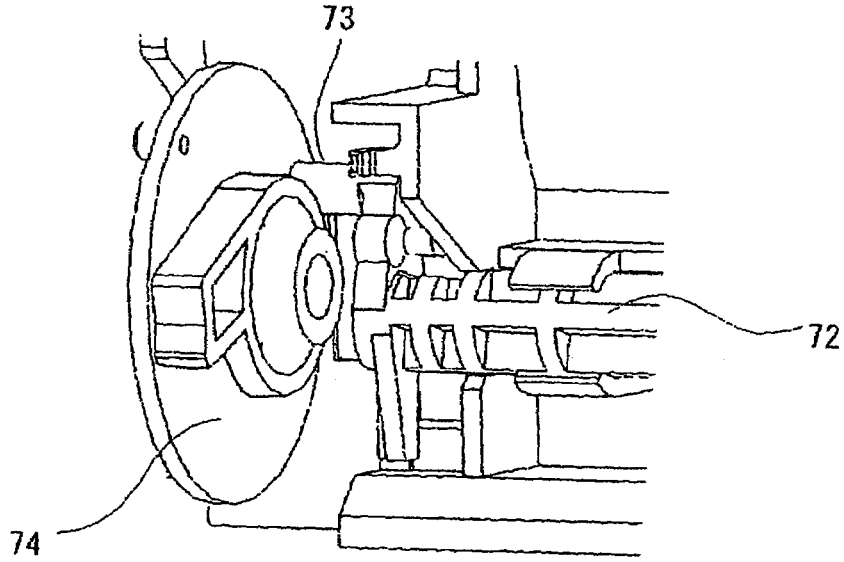
Figure 7A:
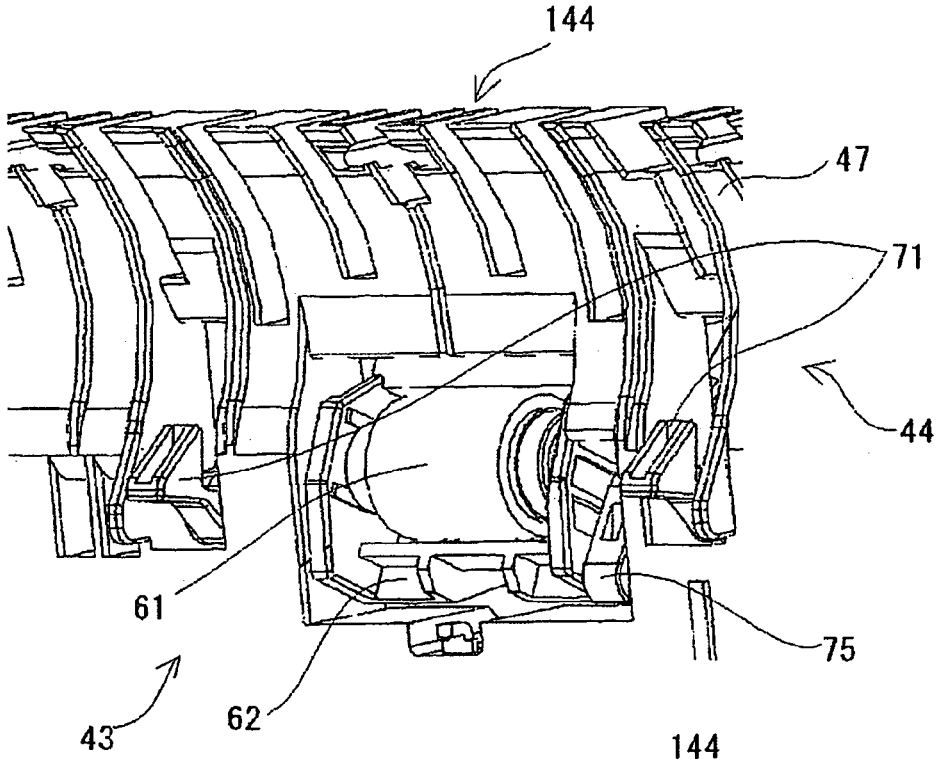
FIGS. 7A and 7B are perspective views of FIG. 6A when viewed from the front side.
Figure 7B:
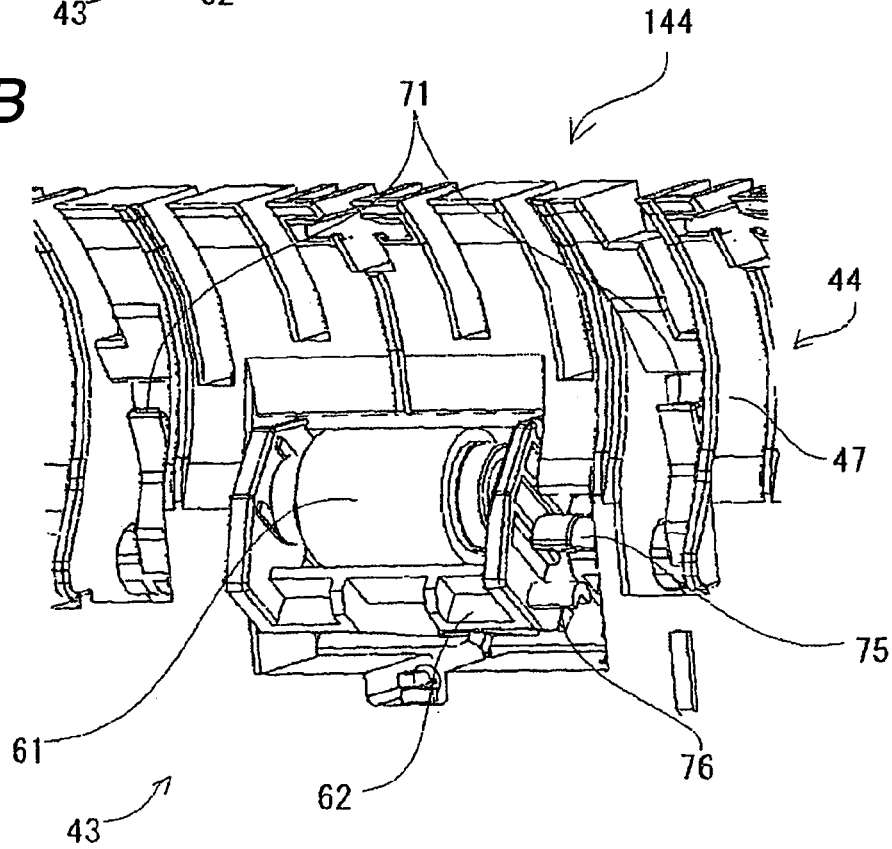

FIG. 6A is a perspective view of the details of the main part of the front ASF 144 when viewed from the rear side and FIG. 6B is an enlarged view of FIG. 6A. FIGS. 7A and 7B are perspective views thereof when viewed from the front side. The front ASF 144 includes the retard roller unit 43 for separating the sheets of paper pile-fed by the pick-up roller unit 41, which is the feature of the invention, into a single sheet, and the front paper returning unit 44 for returning the remaining sheet(s) separated by the retard roller unit 43 to the paper supply tray 142.

The retard roller unit 43 includes a retard roller 61 for separating only the uppermost sheet to be fed from the sheets of paper pile-fed in contact with the intermediate roller 45, and a roller holder 62 for rotatably axial-supporting the retard roller 61 so that it touches or leaves the intermediate roller 45. The retard roller 61 is formed in a cylindrical shape and its circumferential face is covered with e.g. rubber in order to enhance the friction coefficient. The roller holder 62 rotatably pivots the retard roller 61 at the one end with the other end being rotatably supported by the frame 47. So the roller holder 62 swingably holds the retard roller 61 so that the one end side can be turned around the other end side.

The front paper returning unit 44 includes paper returns 71 for forcibly returning the lower sheet(s) separated by the retard roller 61 in contact with the tip thereof, a paper returning shaft 72 for turning the paper return 71 and swinging the retard roller 61, and a cam follower 73 and cam clutch 74 as shown in FIG. 6 for transmitting the driving force sent from a supplying motor not shown to the paper returning shaft 72. The paper returns 71 are formed in a lug shape and integrally to the paper returning shaft 72 so that they protrude from the paper returning shaft 72 on both sides of the retard roller 61. The cam follower 73 is formed in an L shape and integrally to the paper returning shaft 72 so that it protrudes from the one end of the paper returning shaft 72. The cam clutch 74 is rotatably supported by the frame 47 and formed in a shape capable of touching or leaving the cam follower 73 in order to intermittently rotate the paper returning shaft 72.

The paper returning shaft 72 is rotatably supported by the frame 47. Now, as described above, since the paper returns 71 are located on both sides of the retard roller 61, if the paper returning shaft 72 is formed in a straight rod shape, it interferes with the roller holder 62. So, as seen from FIG. 6, the portion 72*a* of the paper returning shaft 72 interfering with the roller holder 62 is formed in a crank shape so as to step aside from the roller holder 62.

Further, the paper returning shaft 72 has a function for turning the paper return 71 and also swinging the retard roller 61. Therefore, as seen from FIG. 7, a cam 75 for turning the roller holder 62 is formed integrally to the paper returning shaft 72, and a cam follower 76 which touches or leaves the cam 75 is formed integrally to the roller holder 62. By forming the crank 72*a* of the paper returning shaft 72, paper returns 71 and cam 75 in their adjusted phases, when the paper returning shaft 75 is rotated, without interfering with the roller holder 72, the paper returns 71 can be turned and the retard roller 61 can be swung. Referring to the drawings, an explanation will be given of the operation of the retard roller unit 43 and front paper returning unit 44 having the configuration described above.

Figure 8A:
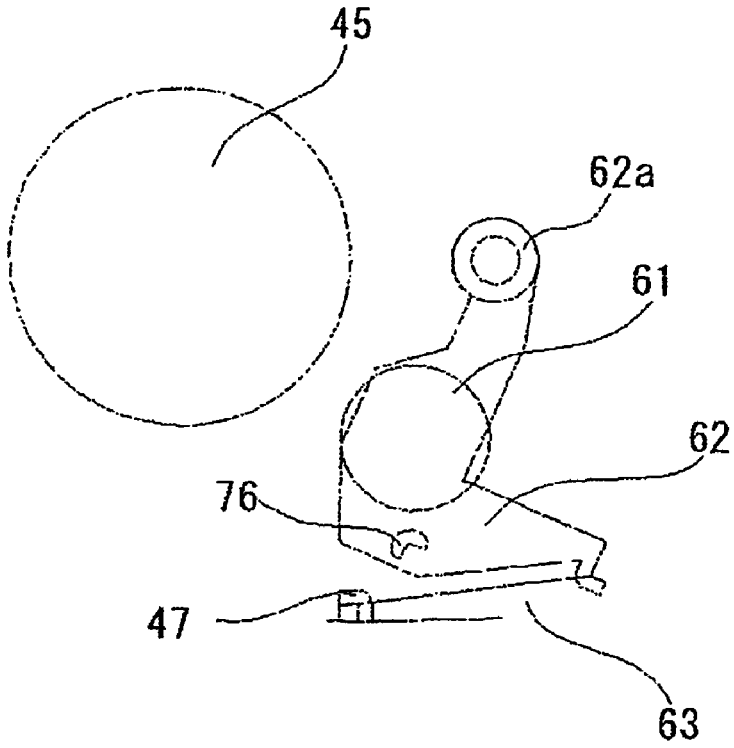
FIGS. 8A and 8B are side views viewed from the right side of the front side corresponding to FIGS. 7A and 7B respectively.
Figure 8B:
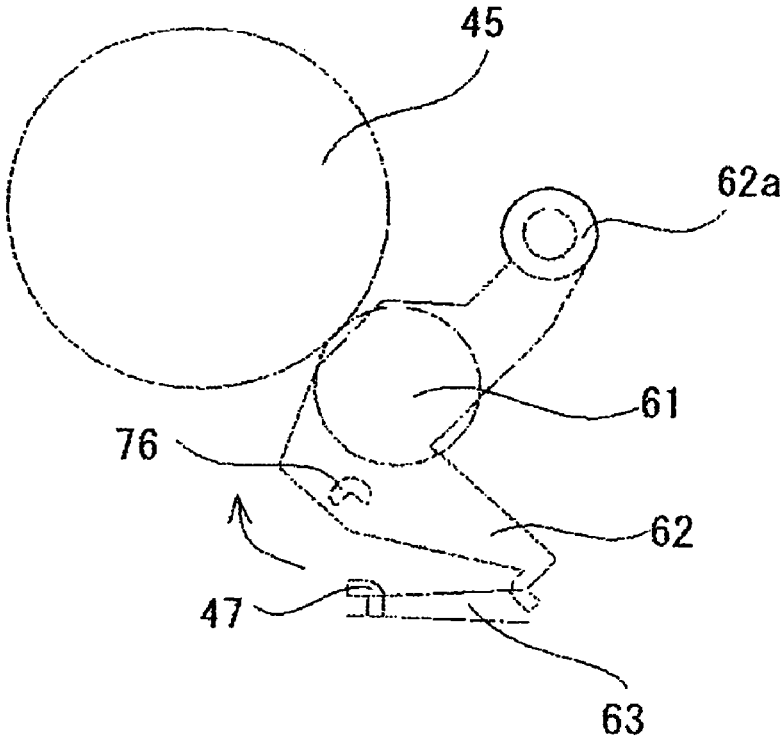
Figure 9A:
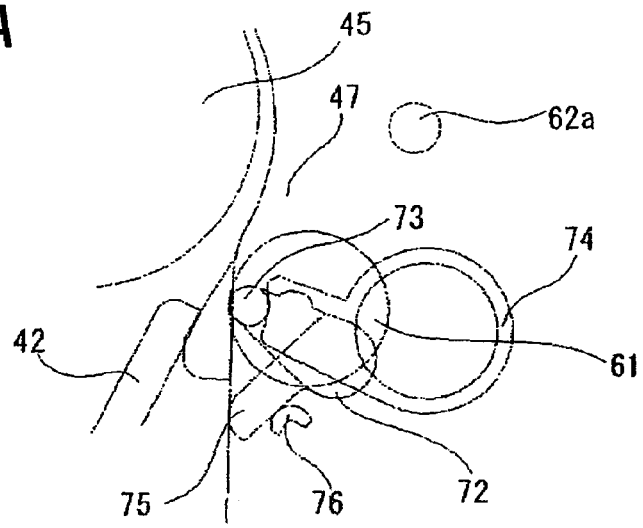
FIGS. 9A to 9C are first side views showing the operation of a cam follower and cam clutch; a cam and cam follower; and a retard roller from standby to paper supply when viewed from the right side of the front side.
Figure 9B:
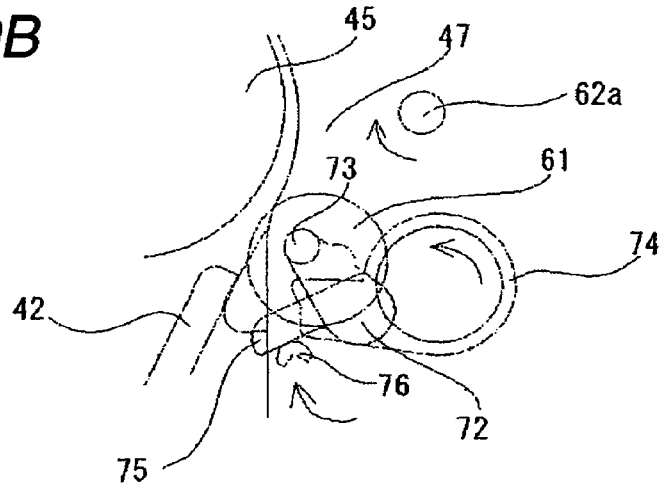
Figure 9C:
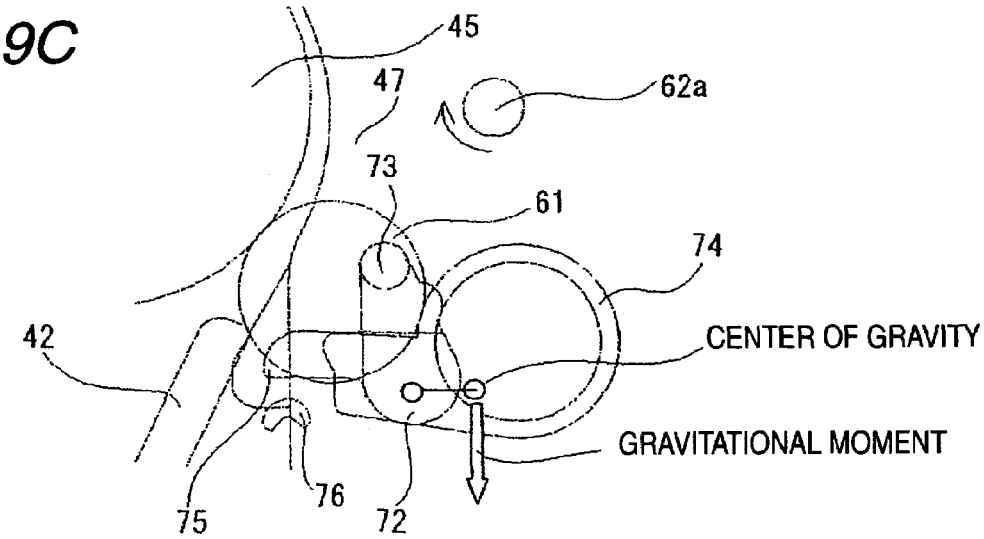

FIG. 7A is a perspective view showing the state of the retard roller unit 43 and front paper returning unit 44 during standby or recording. FIG. 7B is a perspective view of the retard roller unit 43 and front paper returning unit 44 in the state during paper supply. FIGS. 8A and 8B are side views showing the positional relationship between the retard roller unit 43 and intermediate roller corresponding to FIGS. 7A and 7B when viewed from the right side of the front side. FIGS. 9 to 11 are side views showing the operation of the cam follower 73 and cam clutch 74; the cam 75 and cam follower 76; and the retard roller 61 from the standby to paper supply when viewed from the right side of the front side. FIGS. 12 and 13 are side views showing the operation of the cam follower 73 and cam clutch 74; and the paper returns 71 from standby to paper supply when viewed from the right side of the front side.

During standby, as seen from FIGS. 7A and 8A, the retard roller 61 is in a state having left the intermediate roller 45 and retracted into the frame 47 and the paper return 71 is in the state having protruded from the frame 47. Specifically, as shown in FIG. 8A, the roller holder 62 is state always pulled by a pulling spring 63 secured between itself and the frame 47. In this case, during the standby, as seen from FIG. 9A, the cam clutch 74 is in contact with the cam follower 73 formed on the paper returning shaft 72 and the cam 75 formed on the paper returning shaft 72 is counterclockwise pressing the cam follower 76 formed on the roller holder 62. Therefore, as seen from FIG. 8A, the roller holder 62 counterclockwise is rotating around a rotary fulcrum 62*a* and the retard roller 61 has left the intermediate roller 45. Further, as seen from FIG. 12A, the tip of the paper return 71 is located at the position near the bank 42.

When paper supply is started, the cam clutch 74 counterclockwise rotates to leave the cam follower 73 formed on the paper returning shaft 72, and with the aid of the restoring force of the pulling spring 63 secured between the roller holder 62 and frame 47, the cam follower 76 formed on the roller holder 62 counterclockwise presses the cam 75 formed on the paper returning shaft 72. Thus, the roller holder 62 clockwise rotates around the rotary fulcrum 62*a* and the retard roller 61 approaches the intermediate roller 45. The paper return 71 clockwise rotates to leave the bank 42.

During paper supply, as seen from FIGS. 7B and 8B, the retard roller 61 is in the state having protruded from the frame 47 to touch the intermediate roller 45, and the paper return 71 is in the state retracted into the frame 47. Specifically, as seen from 9C, the retard roller 61 protrudes from the frame 47 to touch the intermediate roller 45, with the aid of the restoring force of the pulling spring 63 secured between the roller holder 62 and frame 47, the roller holder 62 clockwise rotates around the rotary fulcrum 62*a*. Then, the cam follower 76 formed on the roller holder 62 is apart from the cam 75 formed on the paper returning shaft 72 so that the paper returning shaft 72 is a free state. However, the paper returning shaft 72 clockwise rotates owing to the gravitational moment generated by the center of gravity behind the paper returning shaft 72. So as seen from FIG. 12B, the paper return 71 clockwise rotates to retract into the frame 47. Incidentally, the load by the retard roller 61 at the contact point between the retard roller 61 and intermediate roller 45 greatly influences the condition of separating the sheets of paper. For this reason, the cam follower 76 formed on the roller holder 62 and the cam 75 formed on the paper return shaft 72 are adapted so that they do not touch each other during paper separation.

Figure 10A:
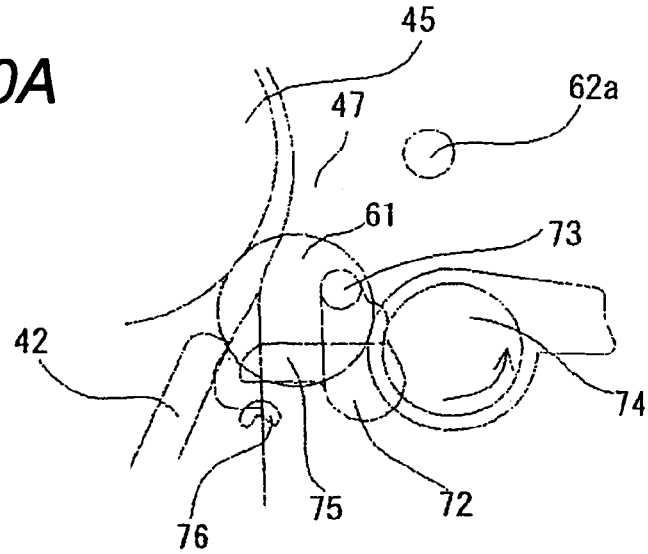
FIGS. 10A to 10C are second side views showing the operation of a cam follower and cam clutch; a cam and cam follower; and a retard roller from standby to paper supply when viewed from the right side of the front side.
Figure 10B:
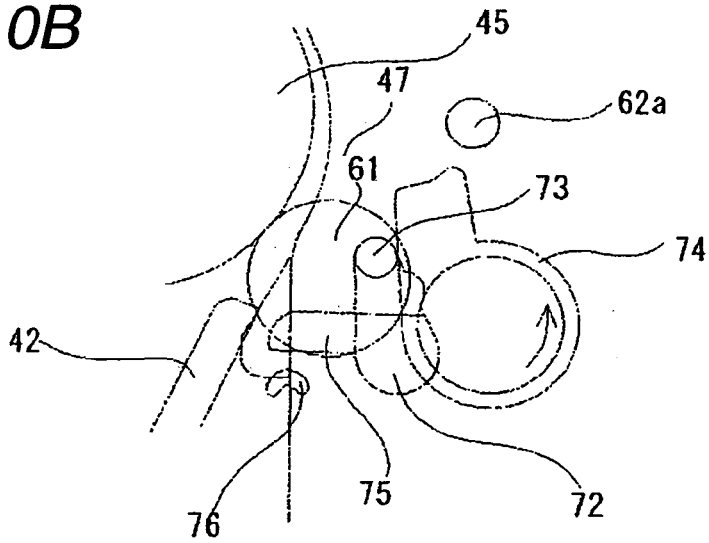
Figure 10C:
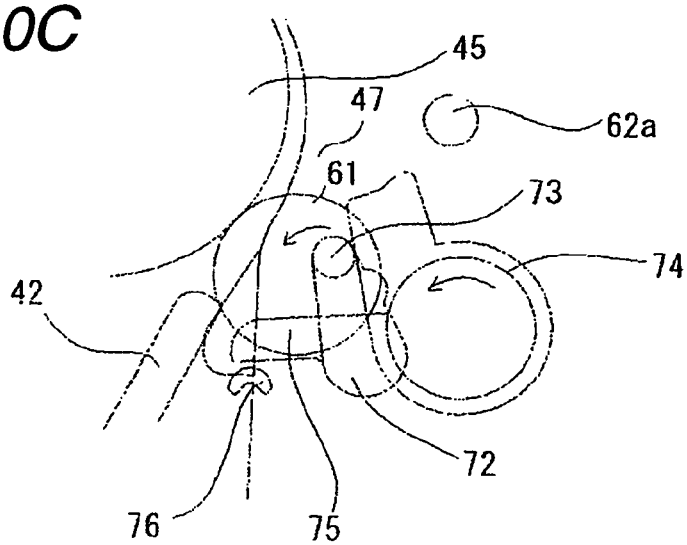
Figure 12A:
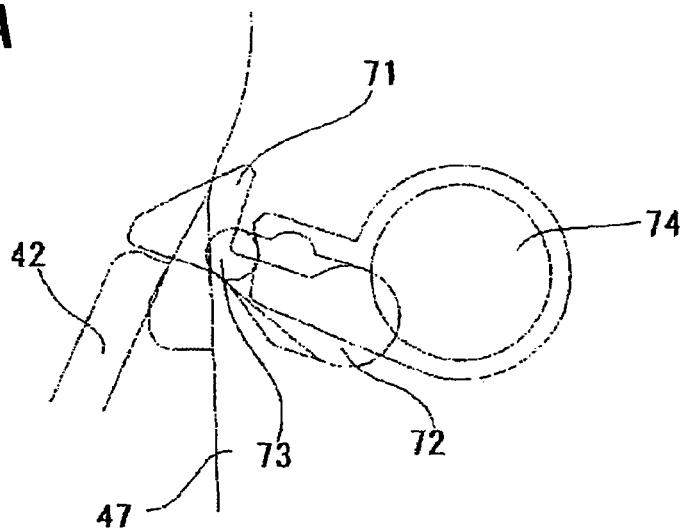
FIGS. 12A to 12C are first side views showing the operation of a cam follower and cam clutch; and a paper return when viewed from the right side of the front side.
Figure 12B:
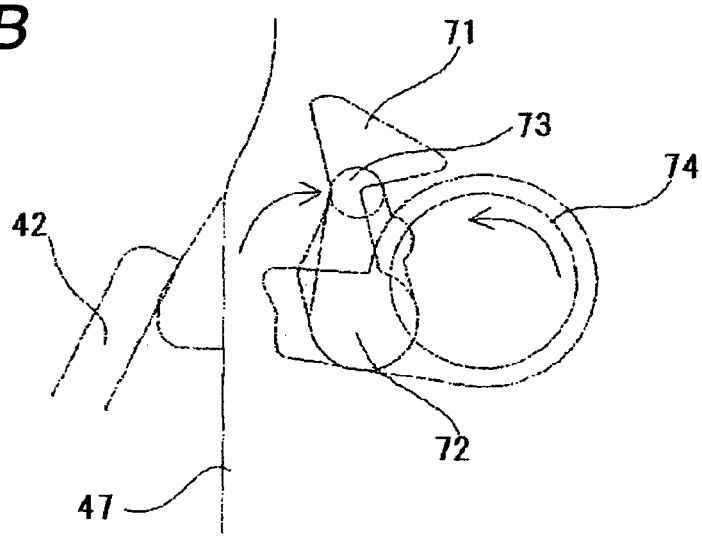
Figure 12C:
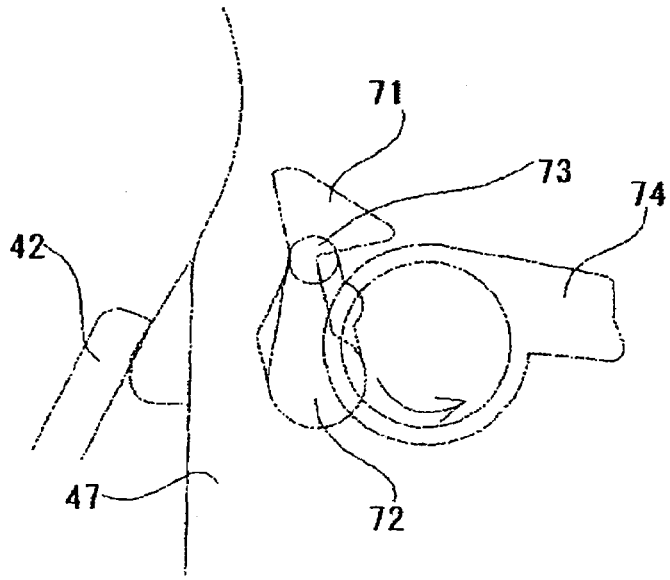
Figure 13A:
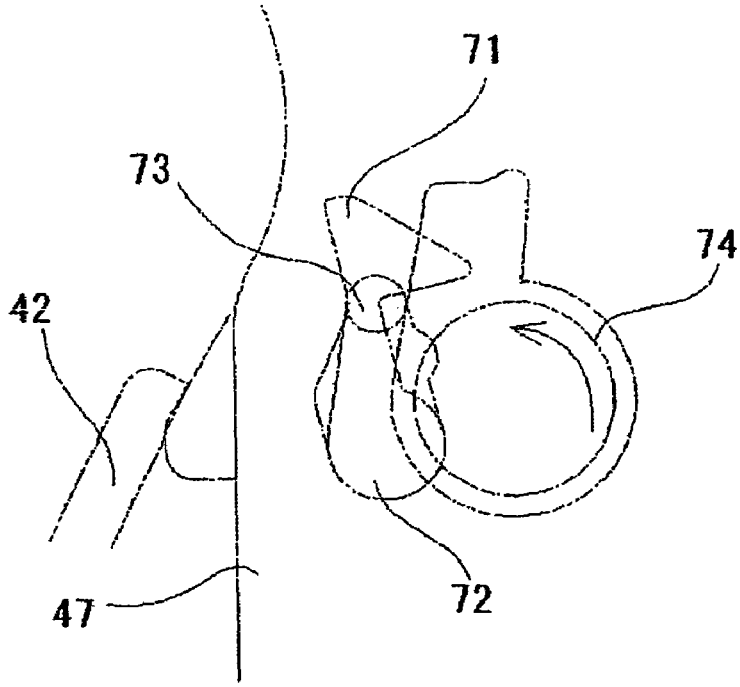
FIGS. 13A and 13B are second side views showing the operation of a cam follower and cam clutch; and a paper return when viewed from the right side of the front side.
Figure 13B:
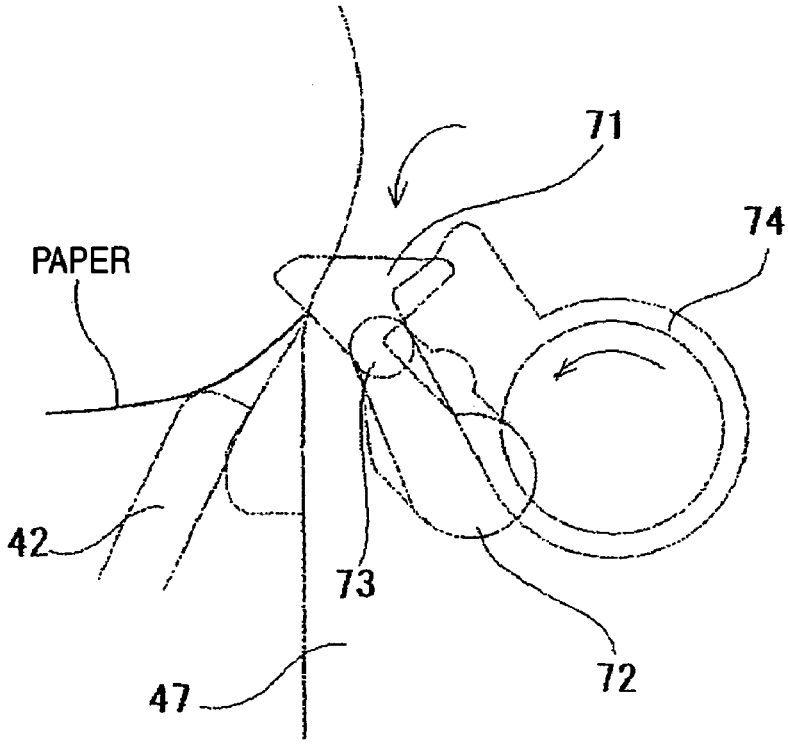

When paper separation is started, as seen from FIGS. 10A and 12C, although the cam clutch 74 rotates counterclockwise, it does not touch the cam follower 73 formed on the paper returning shaft 7. Therefore, the retard roller 61 is kept in the state protruded from the frame 47 and touched the intermediate roller 45, and the paper return 71 is kept in the state retracted in the frame 47. Subsequently, as seen from FIGS. 10A, 10C and 13A, when the cam clutch 74 further rotates counterclockwise to touch the cam follower 73 formed on the paper returning shaft 72, the retard roller 61 is kept in the state protruded from the frame 47 and touched the intermediate roller 45, but the paper return 71 starts to rotate counterclockwise.

Figure 11A:
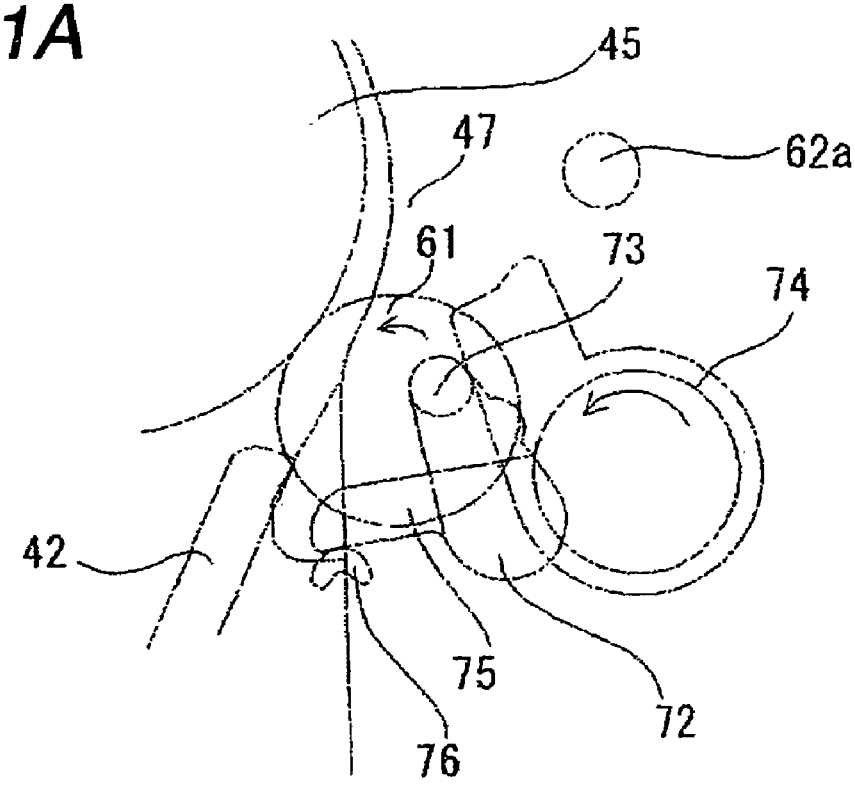
FIGS. 11A and 11B are third side views showing the operation of a cam follower and cam clutch; a cam and cam follower; and a retard roller from standby to paper supply when viewed from the right side of the front side.

When paper separation is completed, as seen from FIG. 11A, the cam clutch 74 further rotates counterclockwise to press the cam follower 73 formed on the paper returning shaft 72 so that the cam 75 formed on the paper returning shaft 72 touches the cam follower 76 formed on the roller holder 62. Thus, the roller holder 62 starts to rotate around the rotary fulcrum 62*a*, and the retard roller 61 starts to leave the intermediate roller 45.

Figure 11B:
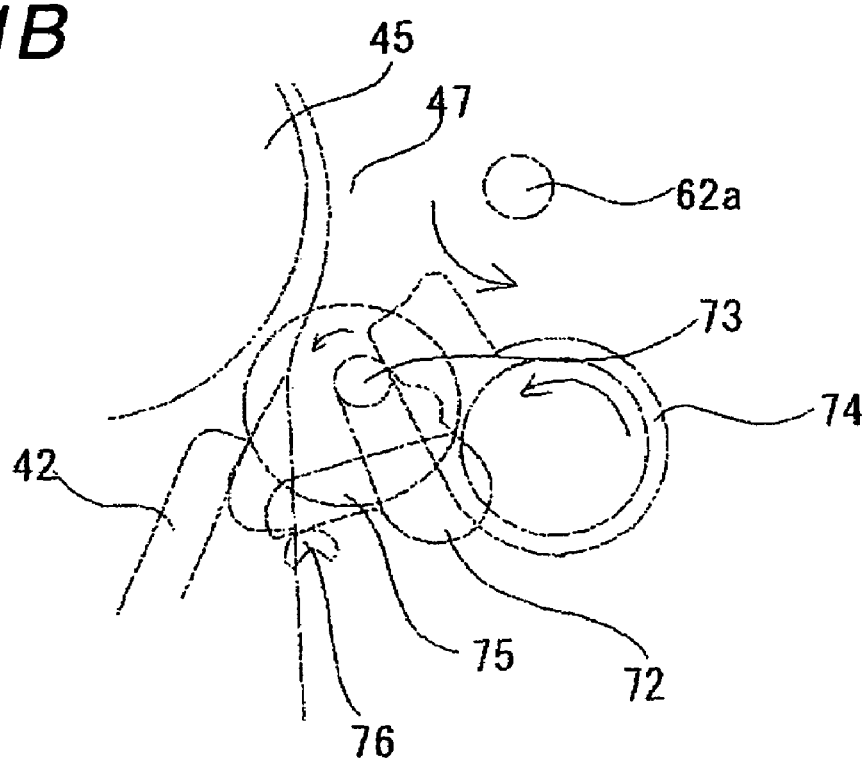

Subsequently, as seen from FIG. 11B, when the cam clutch 74 further rotates counterclockwise to press the cam follower 73 formed on the paper returning shaft 72, and the cam 75 formed on the paper returning shaft 72 counterclockwise presses the cam follower 76 formed on the roller holder 62. Thus, the roller holder 62 further rotates counterclockwise around the rotary fulcrum 62*a* and the retard roller 61 further leaves the intermediate roller 45. Further, as seen from FIG. 13B, the paper return 71 protrudes from the frame 47 so that its tip touches the tip of the separated sheet to start its returning.

And during recording, the cam clutch 74 further rotates counterclockwise to press the cam follower 73 formed on the paper returning shaft 72, and the cam 75 formed on the paper returning shaft 72 further counterclockwise presses the cam follower 76 formed on the roller holder 62. Thus, as seen from FIGS. 7A and 8A, the retard roller 61 falls in the state left the intermediate roller 47 and retracted in the frame 47, and the paper return 71 falls in the state protruded from the frame 47. In this way, the one cycle operation of the retard roller unit 43 and front paper returning unit 44 is completed.

Figure 14A:
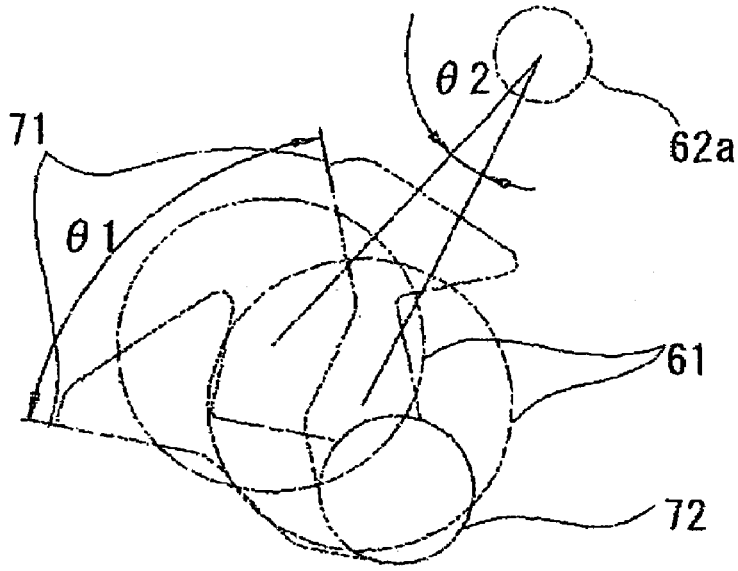
FIG. 14A is a view showing a retard roller and a paper return and FIG. 14B is a view showing a cam and cam follower.
Figure 14B:
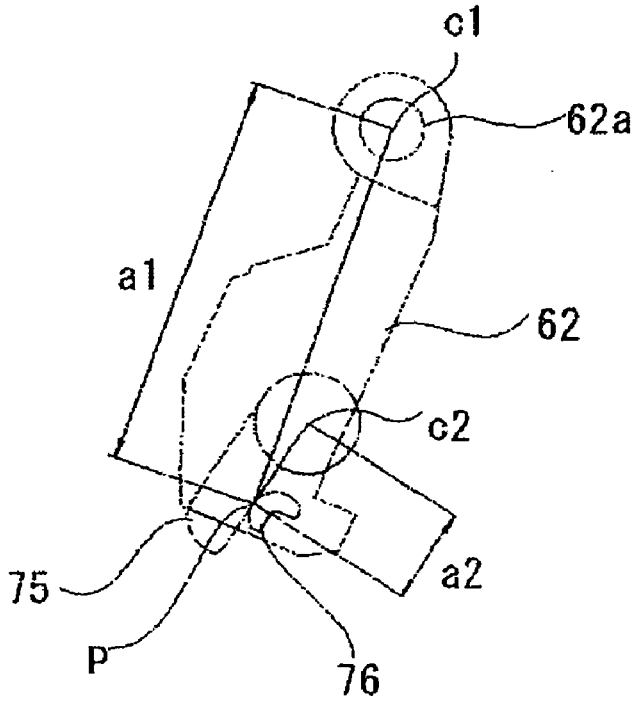

FIG. 14A is a view showing the retard roller 61 and paper return 71. FIG. 14B is a view showing the cam 75 and cam follower 76. The retard roller 61 rotates around the rotary fulcrum 62*a* and the paper return 71 rotates around the paper returning shaft 72. And the locus of the retard roller 61 is restricted to the U-shape passage formed by the intermediate roller 45; the rotary fulcrum 62*a* of the roller holder 62 is restricted to a paper-separation condition; the locus of the paper return 71 is restricted to the locus of the paper; and the paper returning shaft 72 is restricted to the locus of the paper return 71. Therefore, the cam 75 and cam follower 76 must be set so as to satisfy these conditions.

Specifically, as seen from FIG. 14A, the rotation angle θ1 of the paper return 71 is about four times as large as the rotation angle θ2 of the retard roller 61. Therefore, as seen from FIG. 14B, the cam 75 and cam follower 76 are set so that the distance a1 from the contact point P of the cam 75 and cam follower 76 to the center C1 of the rotary fulcrum 62*a* of the roller holder 62 is about four times as large as the distance a2 from the above contact point P to the center C2 of the paper returning shaft 72.

Figure 15A:
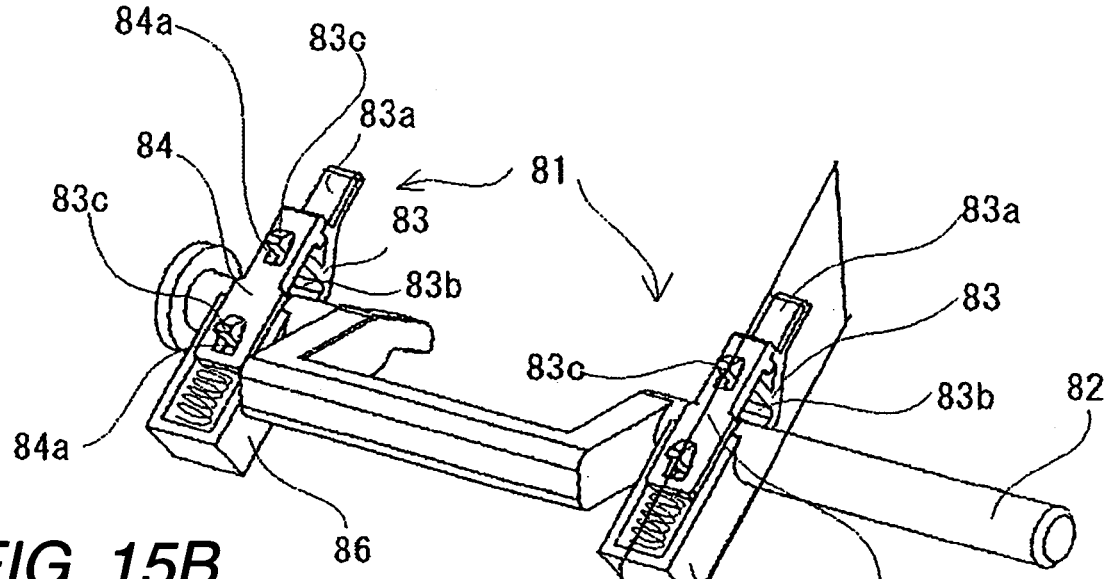
FIG. 15A is a perspective view showing another embodiment of a paper return and a paper return shaft and FIG. 15B is an enlarged section view of FIG. 15A.
Figure 15B:
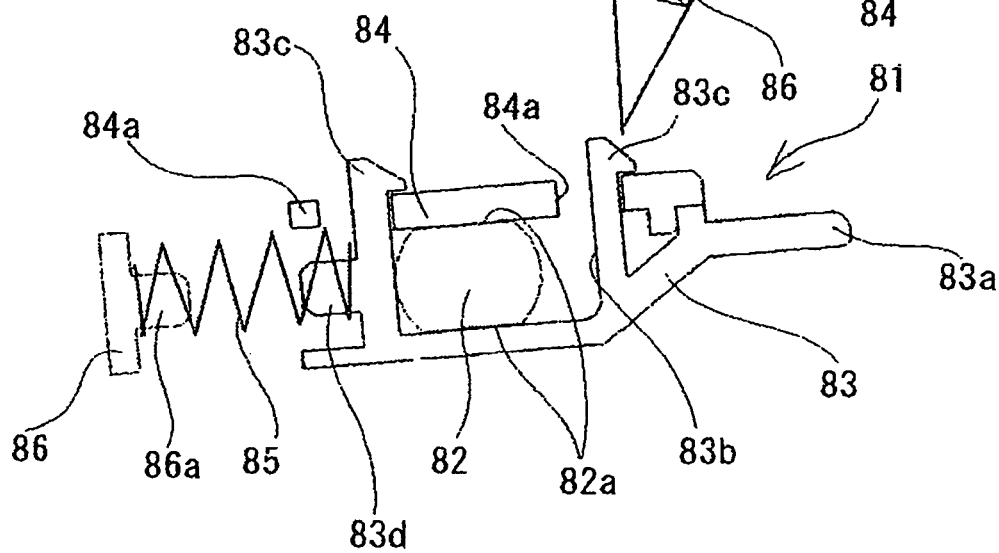

FIG. 15A is a perspective view of another embodiment of the above paper return 71 and paper returning shaft 72. FIG. 15B is a enlarged section view of FIG. 15A. Each of paper returns 81 shown in FIGS. 15A and 15B includes a lug 83, a hold-down plate 84 and a compression spring 85. A paper returning shaft 82 shown in FIGS. 15A and 15B has parallel flat surfaces 82*a* formed on its circumferential portion to which the paper returns 81 are attached. Attachments 86 for the paper returns 81 are formed integrally to the paper returning shaft 82 and in parallel to the flat surfaces 82*a*.

The lug 83 includes a contact 83*a* to be in contact with the paper, a groove 83*b* in which the portion with the flat surfaces 82*a* of the paper returning shaft 82 is inserted, projections 83*c* for securing the hold-down plate 84 and an attachment 83*d* to which one end of the compression spring 85 is attached. The hold-down plate 84 has slots 84*a* in which the projections 83*c* of the lug 83 are inserted. The hold-down plate 84 is attached in the state where the portion with the flat surfaces 82*a* of the paper returning shaft 82 is inserted in the groove 83*b* of the lug 83. The attachment 86 has an attaching piece 86*a* to which the other end of the compression spring 85 is attached. The side of the attachment 83*d* of the lug is inserted in the attachment 86 through the compression spring 85.

In accordance with the paper returns 81 and paper returning shaft 82 having the configuration described above, since the paper return 81 is formed as a body separate from the paper returning shaft 82, the lug 83 of the paper return 81 retracts in or protrudes from the paper returning shaft 82 by the compression spring 85. For this reason, although the above paper return 71, which is formed integrally to the paper returning shaft 72, may injure pliant and hard-to-break paper such as thick paper particularly when it is returned, the paper return 81, which is formed as a body separate from the paper returning shaft 82, retracts particularly when pliant and hard-to-break paper such as thick paper is returned, thereby preventing the paper from being injured.

Now, as also described in connection with the related art, owing to the paper supplying speed based on a paper type and recording mode, number of set sheets of paper and changes in a paper setting manner, if the tips of sheets of paper are uneven, deterioration in the feeding performance such as paper tip buckling by the paper return 71, non-feeding and poor paper tip positioning occurs. In order to obviate such an inconvenience, drive control of the front ASF 144 which is the feature of this invention is carried out as described below.

Figure 16:
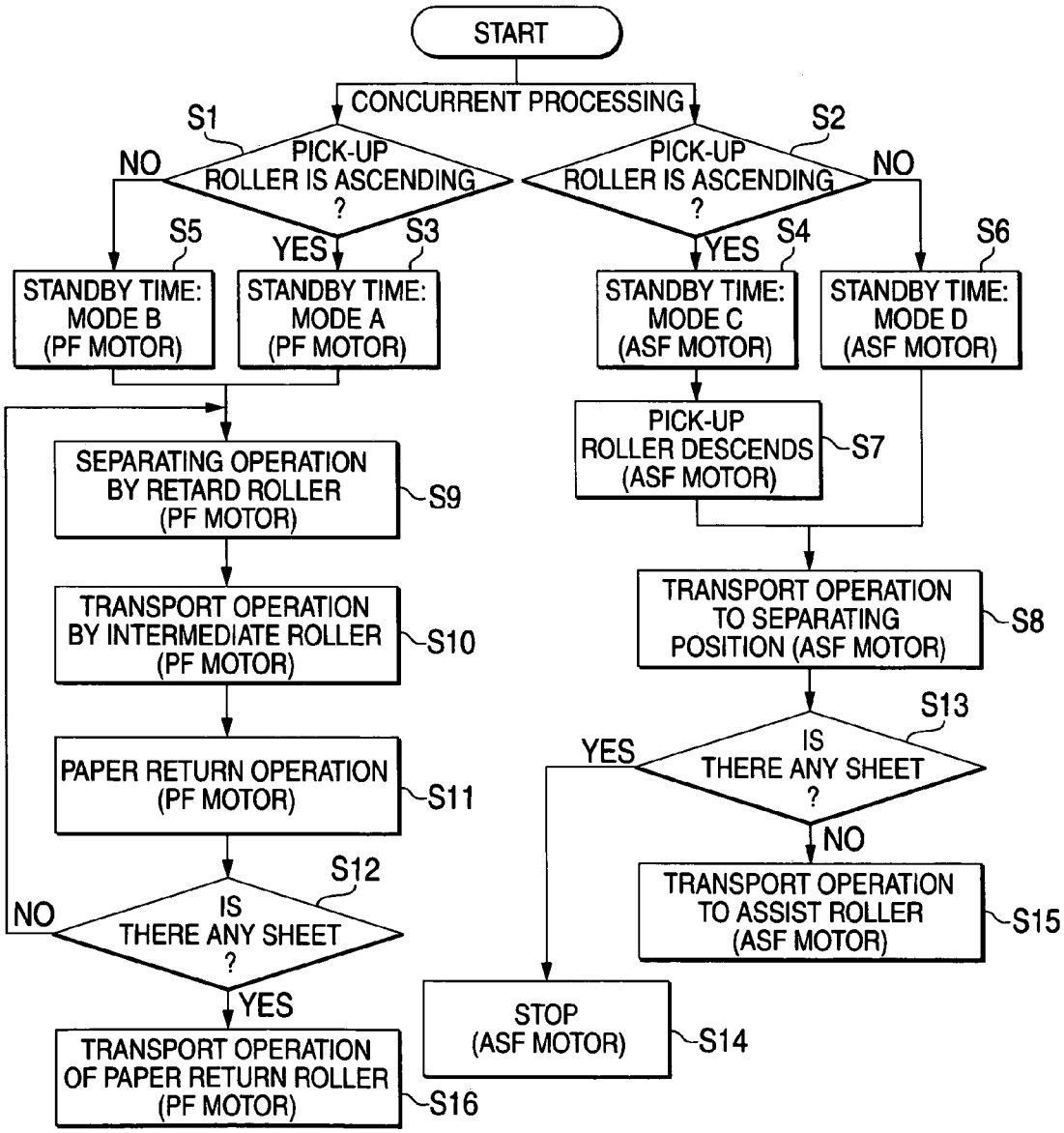
FIG. 16 is a flowchart for explaining the drive control of a front ASF.

FIG. 16 is a flowchart for explaining the drive control of the above front ASF 144. The flowchart is illustrated in the manner divided into the operation of a supplying (ASF) motor for driving the pick-up roller unit 41 and others and that of a paper feeding (PF) motor for driving the retard roller unit 43, front paper returning unit 44, intermediate roller 45, paper feeding roller 151, etc. The operation of the supplying (ASF) motor and that of the paper feeding (PF) motor will be processed concurrently.

First, it is determined whether or not the pick-up roller 41 is ascending, i.e. in continuous paper supply, the sheet of paper at issue is a first sheet or the subsequent sheet (steps S1, S2). And according to whether or not the pick-up roller 41 is ascending, the recording mode is selected. The recording mode designates a paper type such as ordinary paper, thick paper, calendered paper or CD and a recoding condition such as high speed recording or fine recording. According to the recording mode, the standby time of the pick-up roller 41, i.e. rotation stopping time is set and previously stored as a table in a memory of the control unit. This is because the paper supplying time is changed according to the status of the pick-up roller 41 and recording mode. Incidentally, as the rotation stopping operation of the pick-up roller unit 41, the standby time, i.e. rotation stopping time was defined. However, without being limited, the timing of rotation stopping may be set and previously stored as a table in the memory of the control unit.

In step S1, if the pick-up roller 41 is ascending, on the side of the paper feed (PF) motor, a recording mode A is selected whereas on the auto sheet feeder (ASF) motor, recording mode C is selected (steps S3, S4). On the other hand, if the pick-up roller 41 is descending, on the side of the paper feed (PF) motor, a recording mode B is selected whereas on the auto sheet feeder (ASF) motor, a recoding mode D is selected (steps S5, S6).

On the side of the auto sheet feeder (ASF) motor, if the pick-up roller unit 41 is ascending in step S2, it starts to descend (step S7). And the transporting operation of the sheets of paper to the paper separating position from the paper supply tray 142 is started (step S8). On the other hand, on the side of the paper feed (PF) motor, the paper separating operation is started by the retard roller 61 (step S9). Further, the paper transporting operation is started by the intermediate roller 45 (step S10) and the paper returning operation is started by the paper return 71 (step S11). These operations are carried out until the paper is detected by the paper detecting sensor (step S12).

On the side of the auto sheet feeder (ASF) motor, it is determined whether or not the paper has been detected by the paper detecting sensor (step S13). If the paper is detected by the paper detecting sensor, the auto sheet feeder (ASF) motor is stopped (step S24). If the paper is not detected by the paper detecting sensor, the paper transporting operation is continued by the auto sheet feeder (ASF) motor until it reaches the assist roller 46 (step S15). On the other hand, on the side of the paper feed (PF) motor, in step S12, if the paper is detected by the paper detecting sensor, the paper transporting operation is started by the rotation of the roller 151 by the paper feed (PF) roller 151 (step S16).

As described above, since the paper supply speed is fixed according to the recording mode, by setting the standby time corresponding to the speed during the paper supplying operation the tip of the paper when it is supplied can be aligned at a predetermined position. Meanwhile, there is a case where the operation of the pick-up roller unit 41 is not constant. For example, the pick-up roller unit 41 is in the ascending status when the first sheet in the continuous paper supply or only one sheet is present or recording data does not appear during a certain time, but the pick-up roller unit 41 is in the descending status when the second or et seq. in the continuous paper supply is present. In such a case, by monitoring the position of the pick-up roller unit 41 so that its standby time is changeable, differences in the apparent transporting distance can be decreased. Thus, occurrence of the inconvenience such as paper tip buckling by a paper return lever, non-feeding and poor paper tip positioning can be avoided. The above matter will be further explained referring the drawings.

FIG. 17 is a view showing the relationship between the position of the paper return 71 and a paper tip position. The position of the paper return 71 is represented by the cam rotation angle of the cam clutch 74 on the horizontal axis, whereas the paper tip position is represented by the number of steps of the auto sheet feeder (ASF) motor on the vertical axis. Now, in FIG. 17, point A is a paper return catching position where the paper is stopped to be bent or injured if the paper tip is located when the paper return 71 returns or has already returned to the standby state in the case where the paper reaches latest (only one sheet of paper is set while the pick-up roller unit 41 is in the ascending status).

Point B is a deceleration starting marginal position where the stopping position of the paper deviates if its tip is located when great load is applied to the paper feeder (PF) motor by the operation of the paper return 71 while the paper feeder (PF) motor decelerates in the case where the paper reaches earliest (the maximum number of sheets of paper are set to the tip of the paper return 71 while the pick-up roller unit 41 is in the descending status).

Figure 17A:
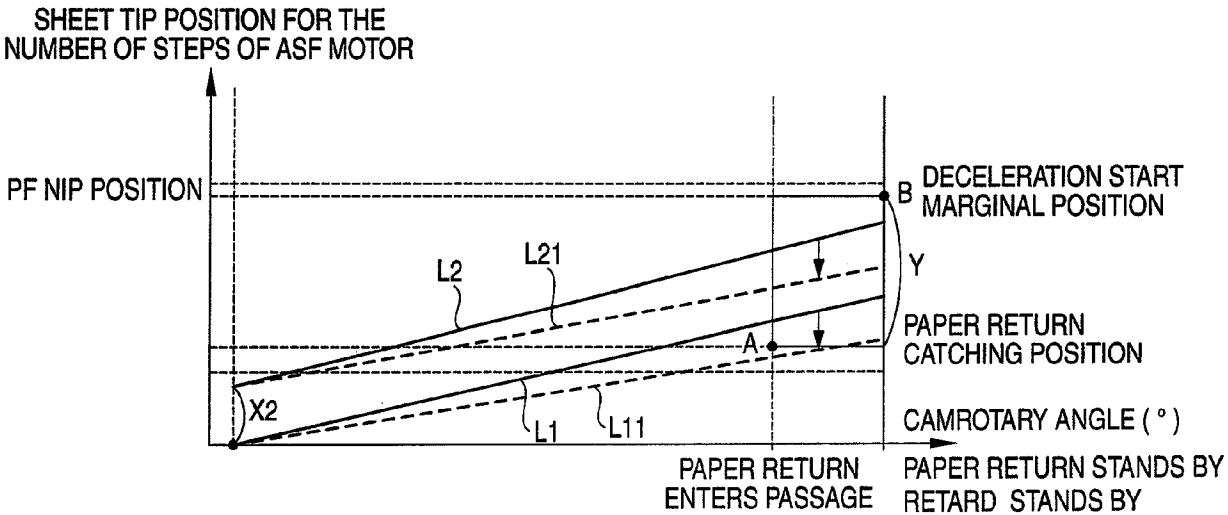
FIGS. 17A and 17B are first views showing the relationship between the position of a paper return and the tip position of paper.

In FIG. 17A, when only one sheet of paper is set in the ascending status of the pick-up roller unit 41, and the maximum number of sheets of paper are set in the descending status of the pick-up roller unit 41, L1 and L2 indicated in solid line which represent the initially designed relationship between the position of the paper return 71 and paper tip position change to L11 and L21 indicated in dotted line owing to the paper supplying speed based on a paper type and recording mode, number of set sheets of paper and changes in a paper setting manner. Now, in L1 located above the point A, the paper tip passes before the paper return 71 returns, thereby permitting normal paper supplying. On the other hand, in L11 located below the point A, the paper return 71 has already returned to the standby state. In this case, the paper is stopped so that it may be bent or injured.

Figure 17B:
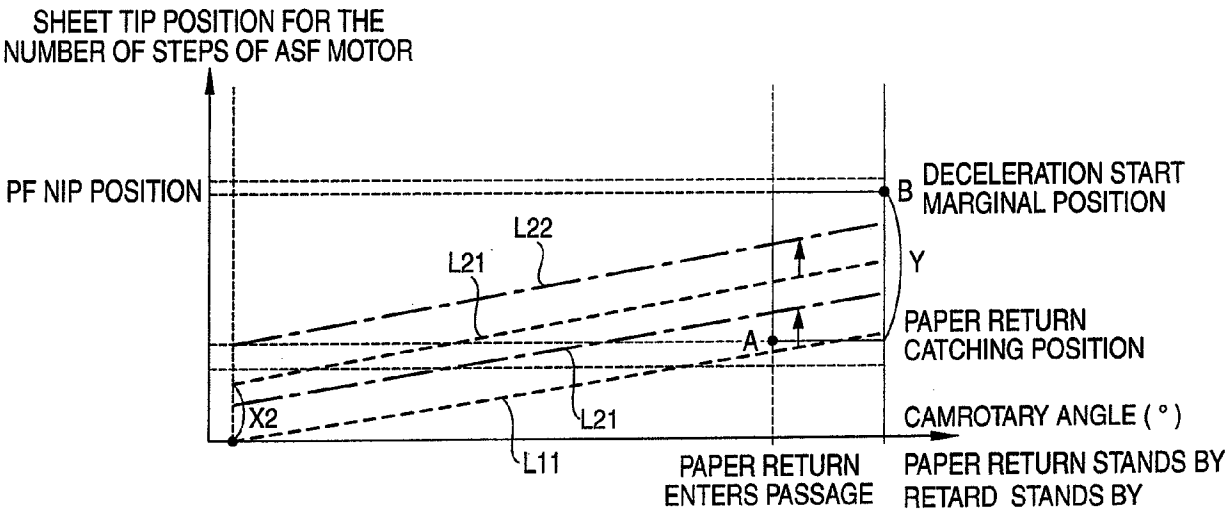

In order to obviate such inconvenience, as described above, by setting the standby time of the pick-up roller unit 41 corresponding to the paper type and recording condition, like L12 and L22 indicated in one-dot chain line in FIG. 17B, the graph of the paper tip position can be located above the point A. Thus, the paper tip can be passed before the paper return 71 returns to the standby status, thereby preventing the paper from being bent or injured.

Figure 18A:
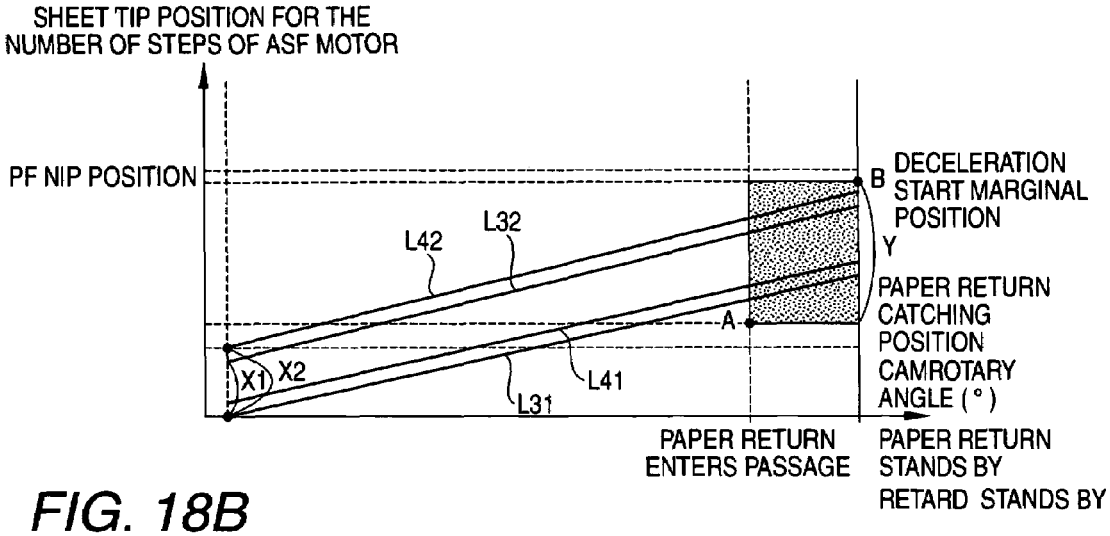
FIGS. 18A to 18C are a second view showing the relationship between the position of a paper return and the tip position of paper.
Figure 18B:
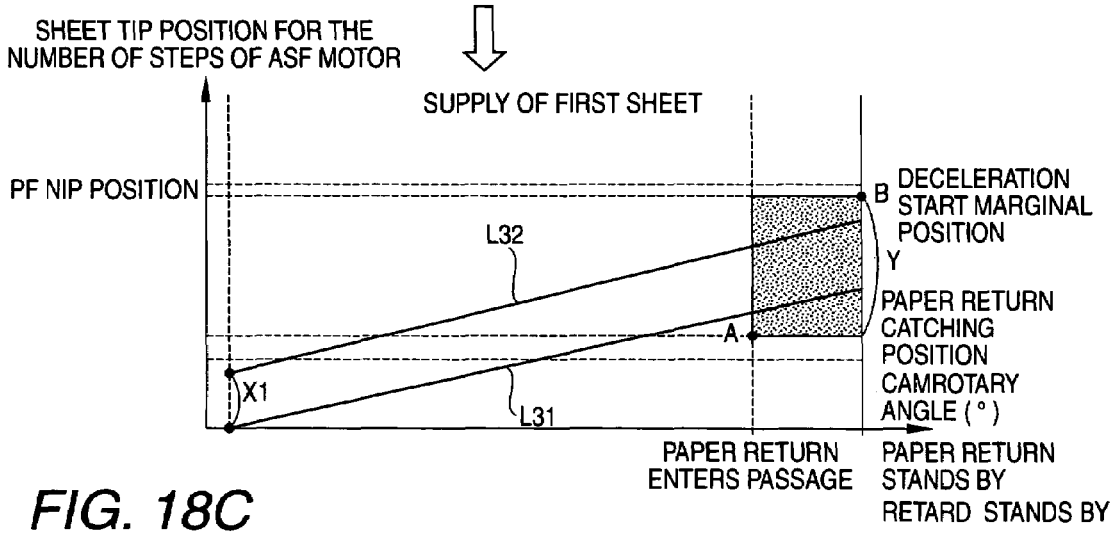
Figure 18C:
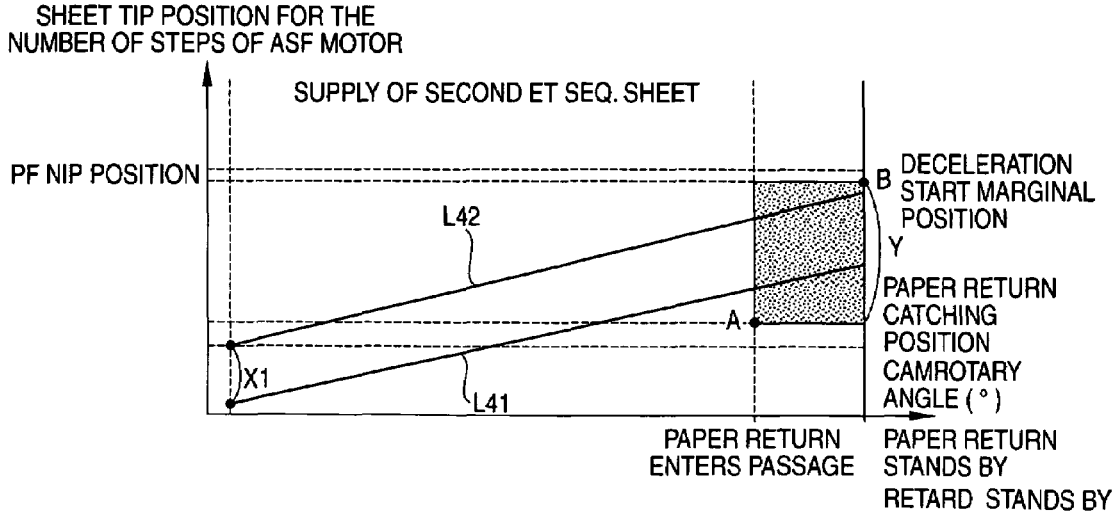

FIG. 18 is a view showing the relationship between the position of the paper return 71 and a paper tip position, which is shown in correlation with the FIG. 17. As described above, the graph of the paper tip position must pass above the point A and below the point B. Therefore, as seen from FIG. 18A, while the pick-up roller unit 41 is in the ascending status, if only one sheet of paper is set, L31 is given and if the maximum number of sheets of paper are set to the tip of the paper return 71, L32 is given. Further, while the pick-up roller unit 41 is in the descending status, if only one sheet of paper is set, L41 is given and if the maximum number of sheets of paper are set to the tip of the paper return 71, L42 is given.

Assuming that the distance from point A to point B is Y, the distance from L31 to L32 is X1, the distance from L41 to L42 is X1 and the distance from L31 to L42 is X2, the margin for two points A and B is (Y−X2). In order to increase this margin, the position of the pick-up roller unit 41 must be distinguished into the cases when it is ascending and when it is descending, i.e. in the cases of the first sheet and the subsequent sheet in the continuous paper supply. By making the standby time changeable according to the position of the pick-up roller unit 41, as seen from FIG. 118B, the margin for the two points A and B can be increased to (Y−X1). Thus, the difference in the apparent transporting distances can be decreased, thereby preventing the paper from being bent or injured.

An explanation will be given of the operation when recording is made for the paper by the ink jet composite machine 100 having the configuration described above. The user houses a plurality of non-recorded sheets of paper in the paper supply tray 142 and starts the ink jet composite machine 100. The sheets of paper pile-housed in the paper supply tray 142, after a predetermined standby time elapses, are friction supply-fed to the intermediate roller 45 by the pick-up roller unit 41. Only the uppermost sheet is separated by the retard roller unit 43 driven by the paper returning shaft 72 and supply-fed, whereas the separated remaining sheet(s) is returned to the paper supply tray 142 by the paper returns 71. The paper, after its skew has been removed and its tip is taken out, is supply-fed to the platen 155 while it is sandwiched between the paper roller 151 driven by the paper feeding mechanism 156 and its following roller 152.

The sheets of paper are subjected to the recording by the recording head 154 loaded on the carriage 153 which is scanned by the carriage motor 159 and carriage belt 158. In this case, the control unit of the ink jet composite machine 100 supplies each color ink to the recording head 154 from the ink cartridges of total seven colors of e.g. yellow, magenta, light-magenta, cyan, light-cyan and black. The control unit controls the jetting timing of each color ink and drive of the carriage 153 and paper feeding roller 151 to carry out ink dot control and half tone processing with high accuracy. And the recorded paper, being sandwiched by the first paper eject roller 51 and first notched roller 52 and by a second paper eject roller 53 and a second notched roller 53, is eject-fed to the paper supply/eject portion 140 and pile-placed onto the paper eject tray 143.

As seen from the description hitherto made, in accordance with the ink jet composite machine 100 according to this embodiment, the operation of stopping the rotation of the pick-up roller unit 41 is inserted in at least before the operation of supplying the sheets of paper to the separating position where the piled sheets of paper are separated into the uppermost sheet and the lower sheet(s) when the sheets of paper are pile-fed by the pick-up roller unit 41 descended and before the operation of returning the lower sheet(s) separated from the piled-fed sheets of paper. Thus, the tips of the sheets of paper supply-fed can be aligned to a predetermined position.

Further, the rotation stopping operation of the pick-up roller unit 41 is changed according to its vertical position, the tips of the first sheet of the sheets of paper continuously supply-fed and the subsequent sheets can be aligned to the predetermined position. Further, since the rotation stopping operation of the pick-up roller unit 41 is changed according to the paper type, preferable paper supplying can be always kept regardless of the status of the paper. Furthermore, since the rotation stopping operation of the pick-up roller unit 41 is changed according to the recording condition, preferable paper supplying can be always kept for various recording formats. Incidentally, these driving methods can be implemented as a set of computer-readable instructions stored in the memory of the control unit of the ink jet composite machine 100 or in a computer readable medium such as a data carrier mounted in the ink jet composite machine 100.

The medium supply-feeing method according to the invention can be applied to a recording machine provided with a medium supplying device such as a facsimile machine, copy machine or scanner. The medium supply-feeing method according to this invention can be applied to not only the recording device, but also to a liquid jetting device for jetting out the liquid according to the use in place of the ink from a liquid jetting head to be applied on a jet medium, provided with e.g. a color material jetting head used for manufacture of a color filter such as a liquid crystal display, an electrode material (conductive paste) jetting head used for manufacture of electrodes of an organic EL display or face light-emitting display (FED), a living body organic jetting head used for manufacture of a bio-chip, or a sample jetting head as a precise pipette.

What is claimed is:

1. A method for driving a medium supplying apparatus which supplies a medium including a plurality of sheets by a pick-up roller, the method comprising:

if at least two of the sheets are fed together by the pick-up roller, then:

separating an uppermost sheet of the at least two of the sheets from a lower sheet or sheets of the at least two of the sheets, at a separating position;

returning the lower sheet or sheets of the at least two of the sheets from the separating position to a downstream position which is disposed downstream of the separating position; and while returning the lower sheet or sheets of the at least two of the sheets to the downstream position, stopping rotation of the pick-up roller in accordance with a type of the medium.

2. The method according to claim 1, wherein the pick-up roller is displaceable between a supplying position and a retracting position, and wherein a time for stopping the rotation of the pick-up roller is changed according to the supplying position and the retracting position.

3. A medium supplying apparatus, wherein the method according to claim 1 can be adopted.

4. A recording device, comprising the medium supplying apparatus according to claim 3.

5. A method for driving the medium supplying apparatus according to claim 4, wherein a time for stopping the rotation of the pick-up roller is changed according to a recording condition.

6. A liquid jetting device, comprising the medium supplying apparatus according to claim 3.

7. A method of controlling a medium supplying device having a pick-up roller driven by a motor, an intermediate roller disposed downstream of the pick-up roller along a medium path, a retard roller facing the intermediate roller, and a return movable to enter the medium path, the method comprising:

contacting the pick-up roller with an uppermost sheet of medium rotating the motor for supplying the uppermost sheet of medium while keeping the pick-up roller in contact with the uppermost sheet of medium;

separating the uppermost sheet of medium from a lower sheet or sheets of medium in a first position of the medium path where the retard roller faces the intermediate roller;

returning the lower sheet or sheets of medium with the return to a second position; and while returning the lower sheet or sheets of medium from the first position to the second position, stopping the motor in accordance with a type of the lower sheet or sheets of medium.

8. The method according to claim 7, wherein a time for stopping the motor is changed according to a position of the pick-up roller.

9. A method of controlling a medium supplying device having a supplying roller driven by a motor, a retard roller facing the supplying roller, and a return movable to enter a medium path, the method comprising:

contacting the supplying roller with an uppermost sheet of medium;

rotating the motor for supplying the uppermost sheet of medium while keeping the supplying roller in contact with the uppermost sheet of medium separating the uppermost sheet of medium from a lower sheet or sheets of medium in a first position of the medium path where the retard roller faces the supplying roller;

returning the lower sheet or sheets of medium with the return to a second position; and while returning the lower sheet or sheets of medium from the first position to the second position, for stopping the motor in accordance with a type of the lower sheet or sheets of medium.

* * * * *